US009551174B2

(12) United States Patent
Bartos et al.

(10) Patent No.: US 9,551,174 B2
(45) Date of Patent: Jan. 24, 2017

(54) LOCK ASSEMBLY

(75) Inventors: Ian Bartos, Blackburn (AU); Harris Lambrou, Blackburn (AU)

(73) Assignee: Gainsborough Hardware Industries Limited, Blackburn, Victoria (AU)

( * ) Notice: Subject to any disclaimer, the term of this patent is extended or adjusted under 35 U.S.C. 154(b) by 305 days.

(21) Appl. No.: 13/985,091

(22) PCT Filed: Feb. 22, 2012

(86) PCT No.: PCT/AU2012/000172

§ 371 (c)(1),
(2), (4) Date: Sep. 26, 2013

(87) PCT Pub. No.: WO2012/122584

PCT Pub. Date: Sep. 20, 2012

(65) Prior Publication Data

US 2014/0008920 A1 Jan. 9, 2014

(30) Foreign Application Priority Data

Mar. 11, 2011 (AU) ..... 2011900885

(51) Int. Cl.
*E05C 1/06* (2006.01)
*E05C 1/10* (2006.01)
(Continued)

(52) U.S. Cl.
CPC ..... *E05C 1/10* (2013.01); *E05B 47/0004* (2013.01); *E05B 63/0065* (2013.01);
(Continued)

(58) Field of Classification Search
CPC ..... E05B 2047/0073; E05B 2047/0076; E05B 47/0673; E05B 47/0004
(Continued)

(56) References Cited

U.S. PATENT DOCUMENTS 1,447,852 A * 3/1923 Huttemann ..... E05B 47/0669 292/DIG. 24
3,513,357 A 5/1970 Dittmore
(Continued)

FOREIGN PATENT DOCUMENTS

WO 9601355 A1 1/1996

OTHER PUBLICATIONS

International Search Report from the ISA/AU (Australian Patent Office) for International Application No. PCT/AU2012/000172, mailed to Applicant on May 1, 2012.
(Continued)

*Primary Examiner* — Mark Williams
(74) *Attorney, Agent, or Firm* — Schiff Hardin LLP

(57) ABSTRACT

A lock assembly (20) including a lock bolt (28), a first hub (36) and a first hub locker (72). The lock bolt (28) is movable between a latching position and an unlatching position. The first hub (36) is adapted to move the lock bolt (28) in response to movement of a first handle. The first hub locker (72) is positionable in at least three positions. The first hub locker (72) allows movement of the lock bolt (28) in response to torque being applied to the first handle when in two of the at least three positions and prevents movement of the lock bolt in response to torque being applied to the first handle when in another of the at least three positions. Alternatively, the first hub locker (72) prevents movement of the lock bolt (28) in response to torque being applied to the first handle when in two of the at least three positions and allows movement of the lock bolt (28) in response to torque being applied to the first handle when in another of the at least three positions.

11 Claims, 20 Drawing Sheets

(51) Int. Cl.

| | |
|---|---|
| ***E05B 47/00*** | (2006.01) |
| ***E05B 63/00*** | (2006.01) |
| ***E05B 63/16*** | (2006.01) |
| *E05B 47/06* | (2006.01) |

(52) U.S. Cl.
CPC ..... *E05B 63/16* (2013.01); *E05B 47/0673* (2013.01); *E05B 2047/0067* (2013.01); *E05B 2047/0073* (2013.01); *E05B 2047/0076* (2013.01); *E05B 2047/0086* (2013.01); *Y10T 292/1014* (2015.04)

(58) Field of Classification Search
USPC ..... 292/138, 359, 358
See application file for complete search history.

(56) References Cited

U.S. PATENT DOCUMENTS

| | | | | |
|---|---|---|---|---|
| 2003/0079508 | A1 | 5/2003 | Lin | |
| 2005/0199026 | A1 | 9/2005 | Geringer et al. | |
| 2005/0218659 | A1 | 10/2005 | Geringer et al. | |
| 2005/0225097 | A1* | 10/2005 | Geringer ..... | E05B 47/0657 292/144 |

OTHER PUBLICATIONS

Written Opinion of the International Preliminary Examining Authority for International Application No. PCT/AU2012/000172, mailed to Applicant on Aug. 7, 2012.

* cited by examiner

LOCK ASSEMBLY

FIELD OF THE INVENTION

The present invention relates to a lock assembly.

The invention has been developed primarily for use with an electrically controllable and electrically powered mortice lock and will be described hereinafter with reference to this application. However, it will be appreciated that the invention is not limited to this particular use and is also suitable for use in other types of locks, such as surface mounted locks.

BACKGROUND OF THE INVENTION

Electrically controllable and/or electrically powered locks are known. Such locks must be set to operate as either fail safe or fail secure. A fail safe lock automatically reverts to an unlocked state when its power supply is interrupted, for example during a power failure. A fail secure lock automatically reverts to a locked state when its power supply is interrupted.

Australian patent No. 657349 discloses an example of a known type of electrically controllable and powered mortice lock which can be set as fail safe or fail secure by adjusting components through openings in the side panels of the lock or after disassembly of the lock. The disadvantage of this arrangement is that the lock must be removed from the door in order to change the lock from fail safe to fail secure.

OBJECT OF THE INVENTION

It is the object of the present invention to substantially overcome or at least ameliorate the above disadvantage, and/or to provide an alternative.

SUMMARY OF THE INVENTION

Accordingly, in a first aspect, the present invention provides a lock assembly, the lock assembly including:

- a lock bolt movable between a latching position and an unlatching position;
- a first hub adapted to move the lock bolt in response to movement of a first handle; and
- a first hub locker positionable in at least three positions, wherein the first hub locker allows movement of the lock bolt in response to torque being applied to the first handle when in two of the at least three positions and prevents movement of the lock bolt in response to torque being applied to the first handle when in another of the at least three positions or the first hub locker prevents movement of the lock bolt in response to torque being applied to the first handle when in two of the at least three positions and allows movement of the lock bolt in response to torque being applied to the first handle when in another of the at least three positions.

The first hub locker preferably allows movement of the lock bolt in response to torque being applied to the first handle when in two of the at least three positions and prevents movement of the lock bolt in response to torque being applied to the first handle when in another of the at least three positions or the first hub locker prevents movement of the lock bolt in response to torque being applied to the first handle when in said two of the at least three positions and allows movement of the lock bolt in response to torque being applied to the first handle when in said another of the at least three positions.

The first hub locker is preferably positionable in at least three positions and the first hub locker allows movement of the lock bolt in response to torque being applied to the first handle when in two of the three positions and prevents movement of the lock bolt in response to torque being applied to the first handle when in another of the three positions or the first hub locker prevents movement of the lock bolt in response to torque being applied to the first handle when in said two of the three positions and allows movement of the lock bolt in response to torque being applied to the first handle when in said another of the three positions.

In one form, the first hub locker allows movement of the lock bolt in response to torque being applied to the first handle when in two of the three positions and prevents movement of the lock bolt in response to torque being applied to the first handle when in another of the three positions. In another form, the first hub locker prevents movement of the lock bolt in response to torque being applied to the first handle when in said two of the three positions and allows movement of the lock bolt in response to torque being applied to the first handle when in said another of the three positions.

The first hub locker is preferably movable in a first direction from one of said two positions to said another position and from said another position to the other of said two positions. The first hub locker is preferably movable in a second direction, opposite to the first direction, from said other of said two positions to said another position and from said another position to said one of said two positions.

The lock assembly preferably includes a first driver, having an extended configuration and a retracted configuration, and a first adjustable mechanism, having an extended configuration and a retracted configuration, wherein:

- when the first driver is in the retracted configuration and the first adjustable mechanism is in the retracted configuration, the first hub locker is positioned in one of said two positions;
- when the first driver is in the retracted configuration and the first adjustable mechanism is in the extended configuration, or the first driver is in the extended configuration and the first adjustable mechanism is in the retracted configuration, the first hub locker is positioned in said another position; and
- when the first driver is in the extended configuration and the first adjustable mechanism is in the extended configuration, the first hub locker is positioned in the other of said two positions.

In one form, the lock assembly preferably includes a first driver, drivable to a retracted configuration and biased to an extended configuration, and a first adjustable mechanism, settable in an extended configuration or a retracted configuration. In another form, the lock assembly preferably includes a first driver, drivable to an extended configuration and biased to a retracted configuration, and a first adjustable mechanism, settable in an extended configuration or a retracted configuration.

The first adjustable mechanism is preferably a first length adjustable mechanism, having a relatively longer length in the extended configuration and a relatively shorter length in the retracted configuration.

The lock assembly preferably also includes:

- a second hub adapted to move the lock bolt in response to movement of a second handle; and
- a second hub locker positionable in at least three positions, wherein the second hub locker allows movement of the lock bolt in response to torque being applied to the second handle when in two of the at least three positions and prevents movement of the lock bolt in response to torque being applied to the second handle when in another of the at least three positions or the second hub locker prevents movement of the lock bolt in response to torque being applied to the second handle when in two of the at least three positions and allows movement of the lock bolt in response to torque being applied to the second handle when in another of the at least three positions.

The second hub locker preferably allows movement of the lock bolt in response to torque being applied to the second handle when in two of the at least three positions and prevents movement of the lock bolt in response to torque being applied to the second handle when in another of the at least three positions or the second hub locker prevents movement of the lock bolt in response to torque being applied to the second handle when in said two of the at least three positions and allows movement of the lock bolt in response to torque being applied to the second handle when in said another of the at least three positions.

The second hub locker is preferably positionable in three positions and the second hub locker allows movement of the lock bolt in response to torque being applied to the second handle when in two of the three positions and prevents movement of the lock bolt in response to torque being applied to the second handle when in another of the three positions or the second hub locker prevents movement of the lock bolt in response to torque being applied to the second handle when in said two of the three positions and allows movement of the lock bolt in response to torque being applied to the second handle when in said another of the three positions.

In one form, the second hub locker allows movement of the lock bolt in response to torque being applied to the second handle when in two of the three positions and prevents movement of the lock bolt in response to torque being applied to the second handle when in another of the three positions. In another form, the second hub locker prevents movement of the lock bolt in response to torque being applied to the second handle when in said two of the three positions and allows movement of the lock bolt in response to torque being applied to the second handle when in said another of the three positions.

The second hub locker is preferably movable in a first direction from one of said two positions to said another position and from said another position to the other of said two positions. The second hub locker is preferably movable in a second direction, opposite to the first direction, from said other of said two positions to said another position and from said another position to said one of said two positions.

The lock assembly preferably includes a second driver, having an extended configuration and a retracted configuration, and a second adjustable mechanism, having an extended configuration and a retracted configuration, wherein:

when the second driver is in the retracted configuration and the second adjustable mechanism is in the retracted configuration, the second hub locker is positioned in one of said two positions;

when the second driver is in the retracted configuration and the second adjustable mechanism is in the extended configuration, or the second driver is in the extended configuration and the second adjustable mechanism is in the retracted configuration, the second hub locker is positioned in said another position; and when the second driver is in the extended configuration and the second adjustable mechanism is in the extended configuration, the second hub locker is positioned in the other of said two positions.

In one form, the lock assembly preferably includes a second driver, drivable to a refracted configuration and biased to an extended configuration, and a second adjustable mechanism, settable in an extended configuration or a retracted configuration. In another form, the lock assembly preferably includes a second driver, drivable to an extended configuration and biased to a retracted configuration, and a second adjustable mechanism, settable in an extended configuration or a retracted configuration.

The second adjustable mechanism is preferably a second length adjustable mechanism, having a relatively longer length in the extended configuration and a relatively shorter length in the retracted configuration.

In a second aspect, the present invention provides a lock assembly, the lock assembly including:

a housing adapted for installation on or in a door;

a lock bolt movable between a latching position and an unlatching position;

a first hub adapted to move the lock bolt in response to movement of a first handle; and a first hub locker assembly settable for fail safe operation or fail secure operation whilst the housing is installed on or in the door.

In a third aspect, the present invention provides a lock assembly, the lock assembly including:

a housing adapted for installation on or in a door;

a lock bolt movable between a latching position and an unlatching position;

a first hub adapted to move the lock bolt in response to movement of a first handle; and a first hub locker assembly settable for fail safe operation or fail secure operation without removing the housing from on or in the door.

The housing preferably includes a front face, installed substantially adjacent the free edge of the door, and the first hub locker assembly is settable for fail safe operation or fail secure operation via access means in the front face of the housing.

The first hub locker assembly preferably includes a first driver, having an extended configuration and a retracted configuration, and a first length adjustable mechanism, settable in an extended configuration or a retracted configuration via the access means.

The first hub locker is preferably positionable in at least three positions, wherein the first hub locker allows movement of the lock bolt in response to torque being applied to the first handle when in two of the at least three positions and prevents movement of the lock bolt in response to torque being applied to the first handle when in another of the at least three positions or the first hub locker prevents movement of the lock bolt in response to torque being applied to the first handle when in two of the at least three positions and allows movement of the lock bolt in response to torque being applied to the first handle when in another of the at least three positions.

The lock assembly preferably includes:

a second hub adapted to move the lock bolt in response to movement of a second handle; and a second hub locker assembly settable for fail safe operation or fail secure operation whilst the housing is installed on or in the door.

The lock assembly preferably includes:

a second hub adapted to move the lock bolt in response to movement of a second handle; and a second hub locker assembly settable for fail safe operation or fail secure operation without removing the housing from on or in the door.

The housing preferably includes a front face, installed substantially adjacent the free edge of the door, and the second hub locker assembly is settable for fail safe operation or fail secure operation via access means in the front face of the housing.

The first hub locker assembly preferably includes a second driver, having an extended configuration and a retracted configuration, and a second length adjustable mechanism, settable in an extended configuration or a retracted configuration via the access means.

The second hub locker is preferably positionable in at least three positions, wherein the second hub locker allows movement of the lock bolt in response to torque being applied to the second handle when in two of the at least three positions and prevents movement of the lock bolt in response to torque being applied to the second handle when in another of the at least three positions or the second hub locker prevents movement of the lock bolt in response to torque being applied to the second handle when in two of the at least three positions and allows movement of the lock bolt in response to torque being applied to the second handle when in another of the at least three positions.

BRIEF DESCRIPTION OF THE DRAWINGS

Preferred embodiments of the present invention will now be described, by way of examples only, with reference to the accompanying drawings wherein.

DETAILED DESCRIPTION OF THE PREFERRED EMBODIMENTS

Figure 1:
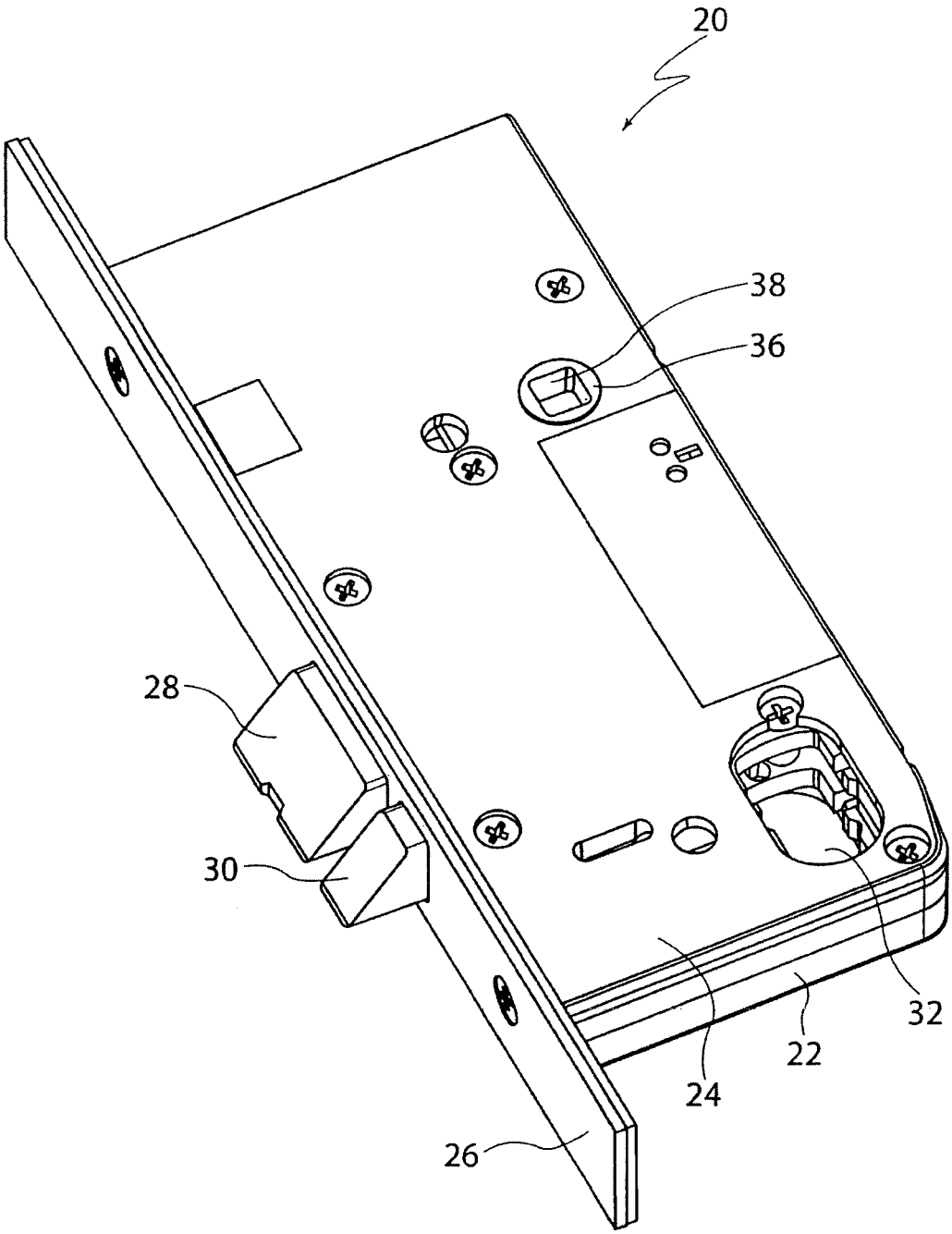
FIG. 1 is a perspective view of a first embodiment of the lock assembly.

FIG. 1 shows an embodiment of an electrically controllable and electrically powered mortice lock assembly 20. The lock assembly 20 includes a housing 22 with a side cover 24 and a face plate 26. The lock assembly 20 is installed in a door with the housing 22 within a mortice void in the door and the face plate 26 adjacent to the non-hinged edge of the door, as is well understood by persons skilled in the art. A latch bolt 28 and an auxiliary bolt 30 pass through the faceplate 26 for engagement with a strike plate (not shown) in a door jamb, as is also well understood by persons skilled in the art. The side of the lock assembly 20 shown in FIG. 1 will be referred to as the first side and the opposite side as the second side.

The lock assembly 20 also includes an opening 32 that receives a key cylinder assembly (not shown) therein. The key cylinder assembly is retained within the opening 32 with a key cylinder retaining pin 34 (see FIG. 7), as is also well understood by persons skilled in the art. After the key cylinder assembly has been inserted into the opening 32, and the key cylinder retaining pin 34 inserted into the key cylinder assembly, the key cylinder retaining pin 34 is prevented from releasing its engagement with the key cylinder assembly by engagement of the faceplate 26 with the housing 22.

The lock assembly 20 also includes a first hub 36 with a square cross section opening 38 therein, which is adapted to engage with a square cross section drive shaft (not shown) of a first external knob, lever or other handle (not shown).

Figure 2A:
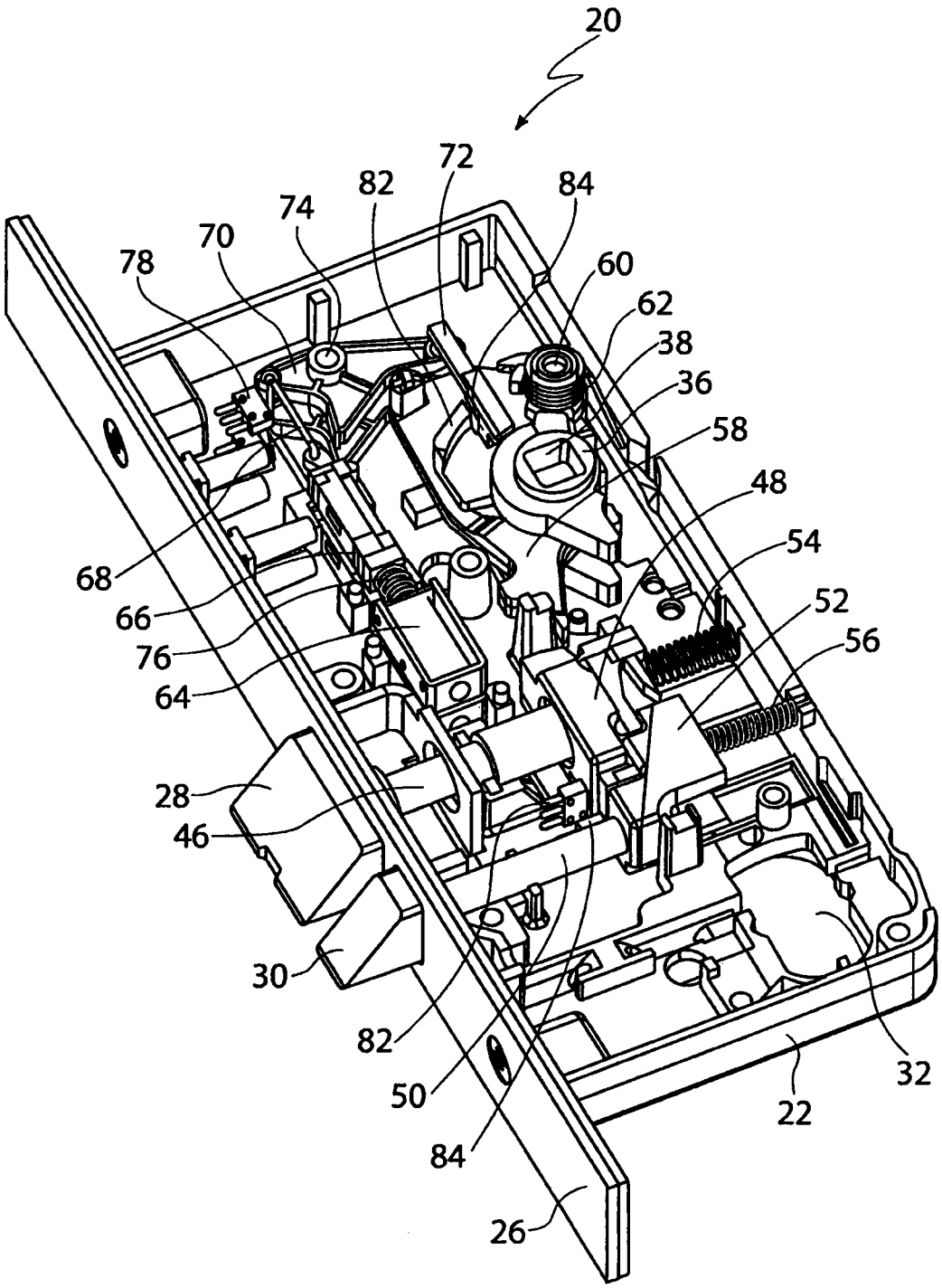
FIG. 2*a* is a perspective view of the lock assembly shown in FIG. 1 with the side cover removed, set to fail safe and not energised/unlocked.

FIG. 2*a* shows the lock assembly 20 with the side cover 24 of the housing 22 removed. The latch bolt 28 is connected to a latch bolt shaft 46 which is in turn connected to a latch bolt carriage 48. The auxiliary bolt 30 is connected to an auxiliary bolt shaft 50 which is in turn connected to an auxiliary bolt carriage 52. The latch bolt 28 and the auxiliary bolt 30 are biased toward a latching position, as shown in FIG. 2*a*, by a latch spring 54 and an auxiliary latch spring 56 respectively.

A carriage retraction arm 58 is pivotally mounted to the housing 22 by a shaft 60 and biased toward the position shown in FIG. 2*a* by a spring 62. The arm 58 can be moved to retract the latch bolt 28 and the auxiliary bolt 30 under certain conditions, in response to movement of the first or second handles or the key cylinder assembly, as will be described in more detail below.

FIG. 2*a* also shows a first electrically powered hub locker assembly comprising a first electrically powered solenoid 64 which is connected to a first length adjustable mechanism 66 which is in turn connected to a first link 68 which is in turn connected to a first lever 70 which is in turn connected to a first hub locking part 72. The first lever 70 pivots about a first boss 74. The first solenoid 64 is of the pull type and also includes a first biasing spring 76.

Figure 2B:
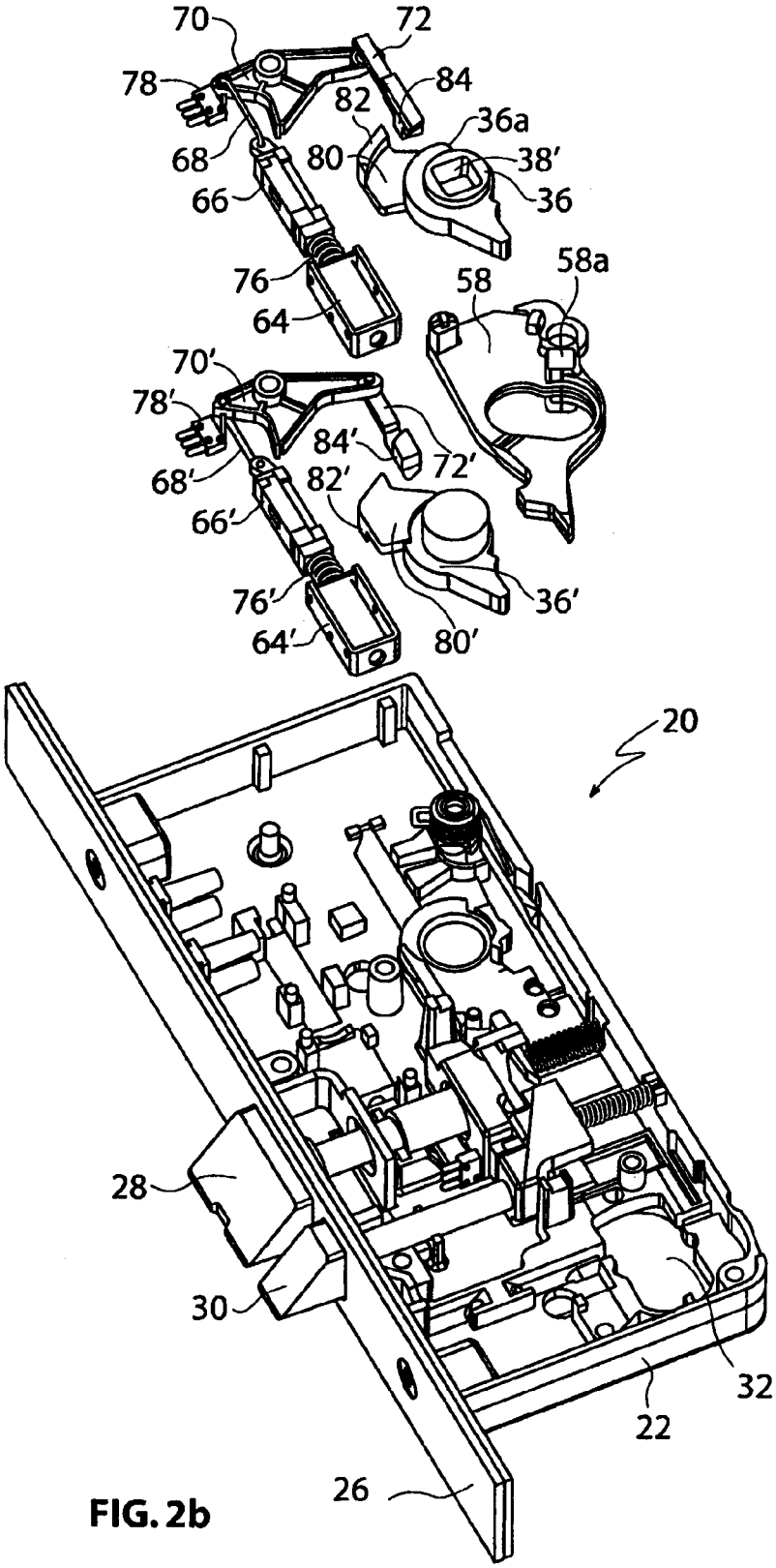
FIG. 2*b* is an exploded perspective view of the lock assembly shown in FIG. 2*a;*

As best shown in FIG. 2*b*, the lock assembly 20 also includes a second handle, a second hub 36' and a second electrically powered hub locker assembly on its opposite side. The second electrically powered hub lock assembly comprises a second electrically powered solenoid 64' which is connected to a second length adjustable mechanism 66' which is in turn connected to a second link 68' which is in turn connected to a second lever 70' which is in turn connected to a second hub locking part 72'. The second electrically powered solenoid 64' is also a pull type and includes a second biasing spring 76'.

FIG. 2*a* also shows a first hub locking sensor 78 which is able to provide a signal indicative of the position of the first electrically powered hub locker assembly to allow remote signalling of the lock status of the first hub 36 to a remotely located controller or other internal control. FIG. 2*b* shows a similar sensor 78' provided for the second hub locker assembly. FIG. 2*a* also shows a latch bolt sensor 82 and an auxiliary bolt sensor 84, which similarly signal the position of the latch bolt 28 and the auxiliary bolt 30 respectively. Other sensors (not shown) can also be added as desired to other mechanical facets of the lock assembly 20 and/or to remotely signal lock and/or door status or to provide other internal control.

FIG. 2*b* also shows that the first hub 36 has a flange 80 carrying a protruding part 82. An identical flange 80' and protruding part 82' are present on the second hub 36'. The first hub locking part 72 also includes a protruding part 84. An identical protruding part 84' is provided on the second hub locking part 72'.

Figure 13A:
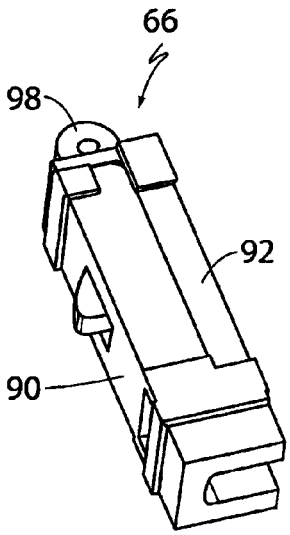
FIG. 13*a* is a perspective view of an length adjustable mechanism in a retracted configuration.
Figure 13B:
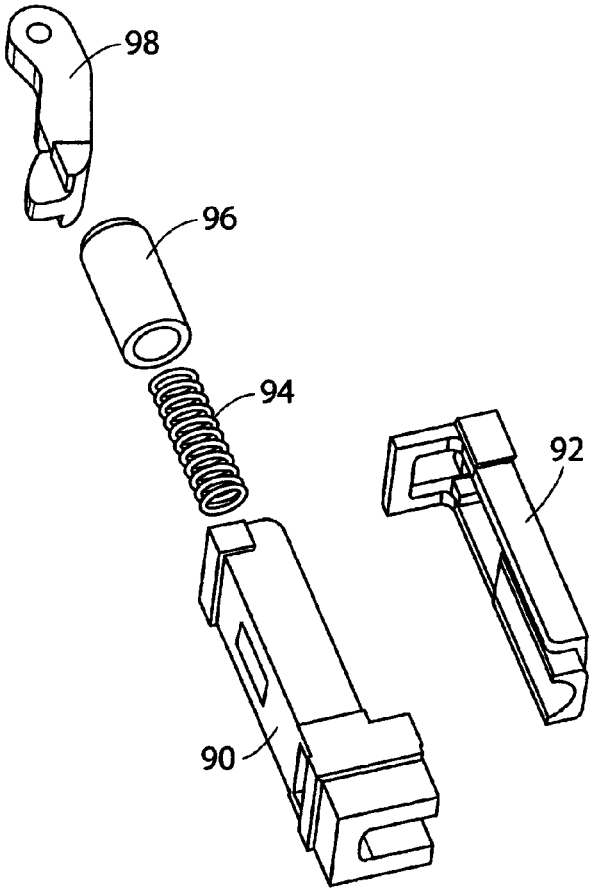
FIG. 13*b* is an exploded perspective view of the adjuster shown in FIG. 13*a;*
Figure 13C:
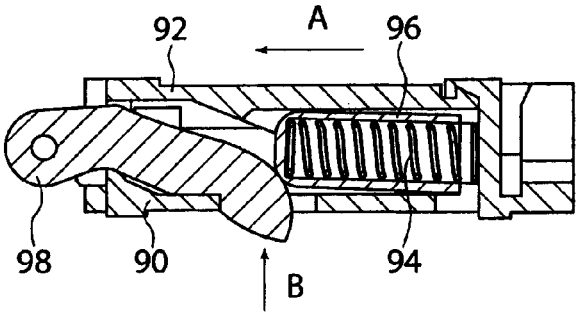
FIG. 13*c* is a cross sectional side view of the adjuster shown in FIG. 13*a;*
Figure 14A:
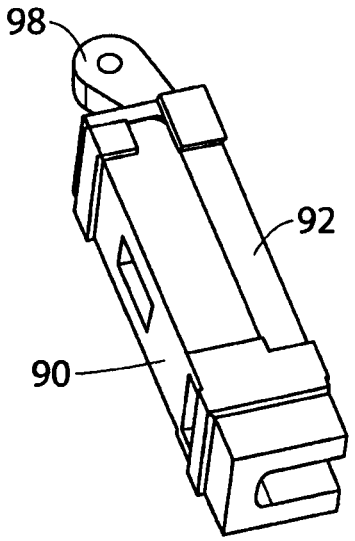
FIG. 14*a* is a perspective view of the adjuster shown in FIG. 13*a* in an extended configuration.
Figure 14B:
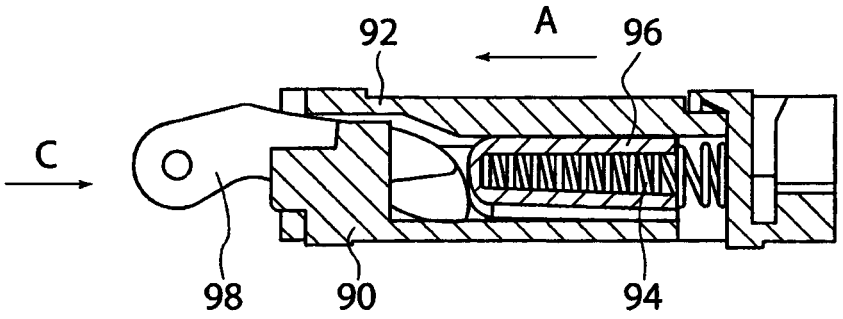
FIG. 14*b* is a cross sectional side view of the adjuster shown in 14*a;*

FIGS. 13*a* to 14*b* show the first length adjustable mechanism 66. The second length adjustable mechanism 66' is identical to the first. FIG. 13*b* shows the component parts of the first length adjustable mechanism 66, namely a first housing part 90, a second housing part 92, a spring 94, a spring cup 96 and a connector 98. The first length adjustable mechanism 66 is settable in either a relatively shorter 'retracted' configuration, as shown in FIGS. 13*a* and 13*c*, or a relatively longer 'extended', configuration as shown in FIGS. 14*a* and 14*b*. In either configuration, the spring 94 continually urges the cup 96 and thus the connector 98 in the direction indicated by arrow A.

When the mechanism 66 is in the retracted configuration shown in FIG. 13*c* the spring 94 maintains the proximal end of the connector 98 in engagement with the first housing part. When force is applied to the proximal end of the connector 98, in the direction of arrow B, then the proximal end of the connector 98 is released from engagement with the first housing part 90 and the connector 98 is propelled by the spring 94 to the extended configuration shown in FIG. 14*b*. When the mechanism 66 is in the extended configuration shown in FIG. 14*b*, then applying force in the direction of arrow C to the distal end of the connector 98 compresses the spring 94 and also causes the connector 98 to pivot, due to the interaction of its curved proximal end against the spring cup 96, until it reaches the retracted configuration shown in FIG. 13*c*. As mentioned above, when the mechanism is in the retracted configuration shown in FIG. 13*c*, the spring 94 maintains the proximal end of the connector 98 in engagement with the first housing part 90.

In summary, applying force in the direction and position of the arrow B changes the mechanism 66 from the retracted configuration to the extended configuration and applying force in the direction and position of the arrow C changes the mechanism 66 from the extended configuration to the refracted configuration.

Figure 4:
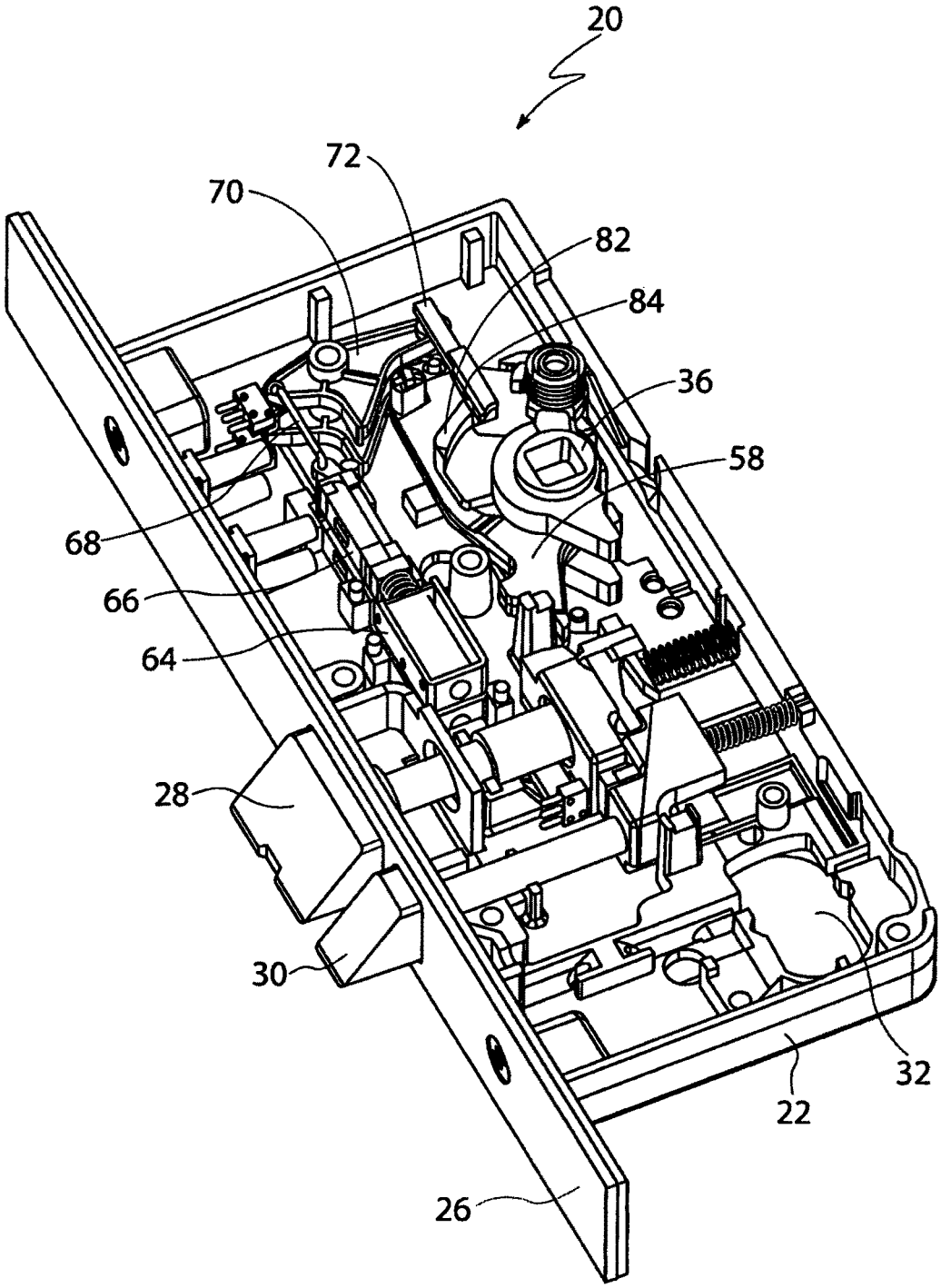
FIG. 4 shows the lock assembly of FIG. 2*a* set to fail safe and energised/locked.

Returning to FIG. 2*a*, the first solenoid 64 also has an extended configuration as shown in FIG. 2*a* and a retracted configuration as shown in FIG. 4. As previously mentioned, the first solenoid 64 is of the pull type and when energized its distal end is pulled to the retracted configuration against the bias of the spring 76. When the solenoid is not energized the spring 76 drives the distal end of the first solenoid 64 to the extended configuration.

Figure 3:
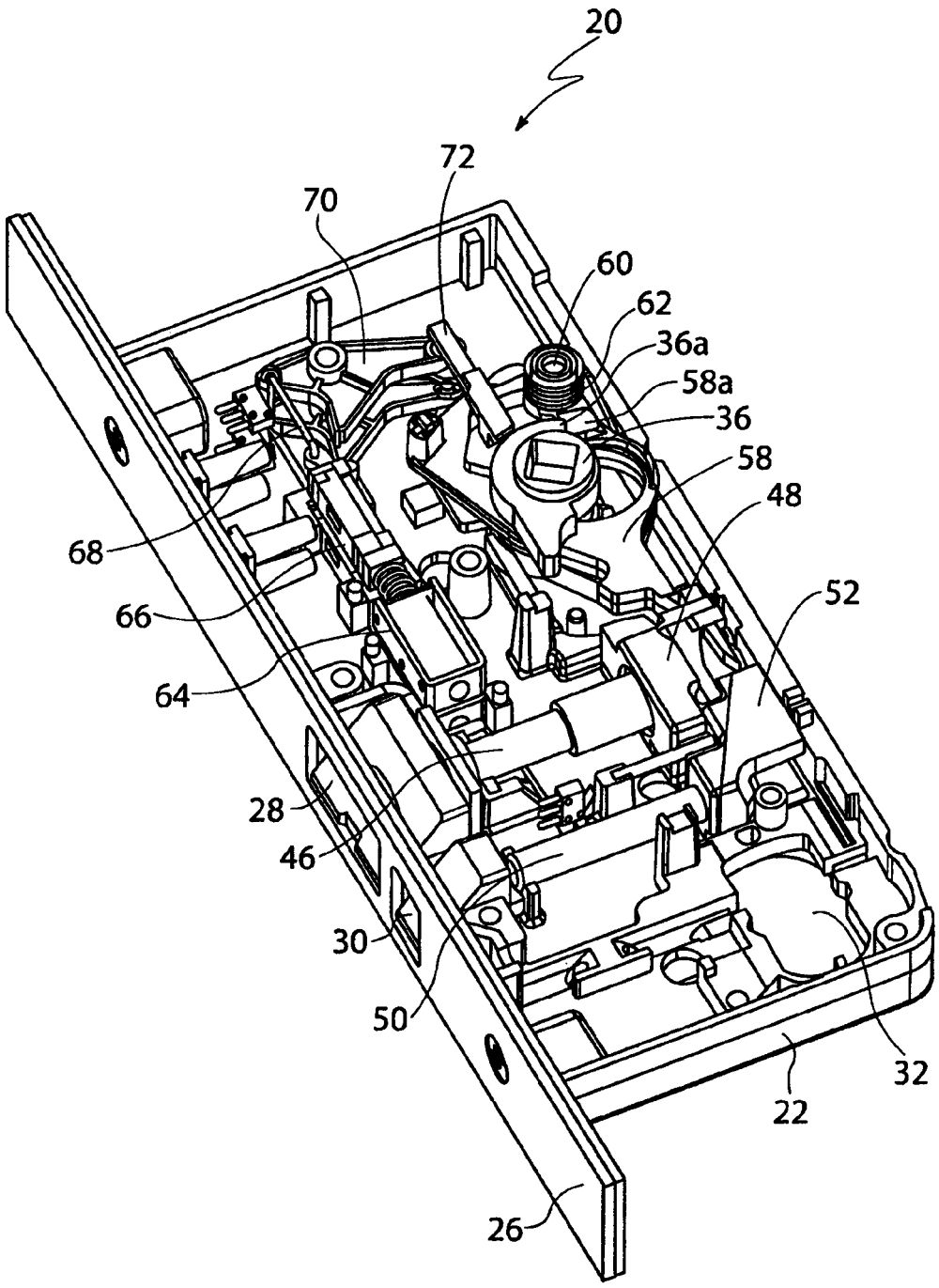
FIG. 3 shows the lock assembly of FIG. 2*a* with a hub rotated and bolts retracted.

The operation of the lock assembly 20 shall now be described. FIG. 2*a* shows the lock assembly 20 set to a fail safe configuration by the setting of the first length adjustable mechanism 66 set in the extended configuration. The first solenoid 64 is shown not energized and thus in the extended configuration. As a result, the first link 68 and the first lever 70 are positioned to place the first hub locking part 72 into what shall be referred to as a first position, relatively close to the first hub 36. In this first position, the protruding part 82 is not aligned with the protruding part 84 and if torque is applied to the first hub 36 the first hub 36 can pivot as the protruding part 82 passes the protruding part 84. The first hub 36 has a first shoulder 36*a* which bears against a protuberance 58*a* on the carriage retraction arm 58 to cause the carriage retraction arm 58 to pivot in response to pivoting of the first hub 36. As shown in FIG. 3, the pivoting of the carriage retraction arm 58, in response to the pivoting of the first hub 36, withdraws the lock bolt 28 and the auxiliary bolt 30, allowing the door to be opened.

FIG. 4 shows the lock assembly set to a fail safe configuration (i.e. the first length adjustable mechanism 66 set in the extended configuration) but with the first solenoid energized and thus in the retracted configuration. As a result, the first link 68 and the first lever 70 are positioned to place the first hub locking part 72 into what shall be referred to as a second position, further away from the first hub 36 than in the first position. In the second position, the protruding part 82 is in alignment with the protruding part 84. Accordingly, when torque is applied to the first hub 36 it is unable to pivot as the protruding part 82 abuts the protruding part 84. This locks the first side of the lock assembly 20.

In summary, when the first length adjustable mechanism 66 is in the extended configuration the first side of the lock assembly 20 is set as fail safe and de-energising the first solenoid 64 drives the first locking part 72 to the first position, unlocking the first side of the lock assembly 20, and energising the first solenoid 64 drives the first locking part 72 to the second position, locking the first side of the lock assembly 20.

Figure 5:
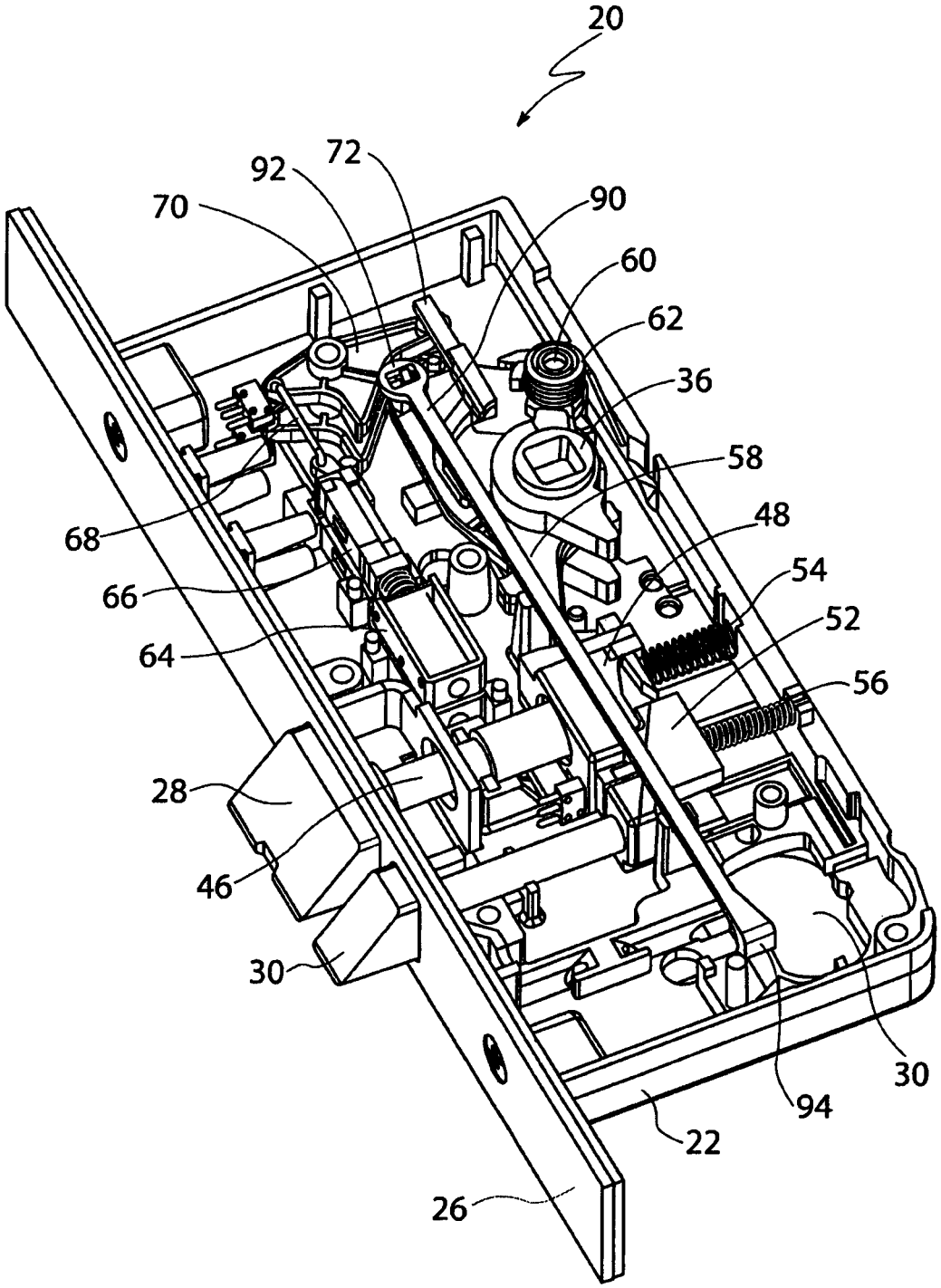
FIG. 5 shows the lock assembly of FIG. 4 with additional parts to provide for bolt retraction via key override.
Figure 6:
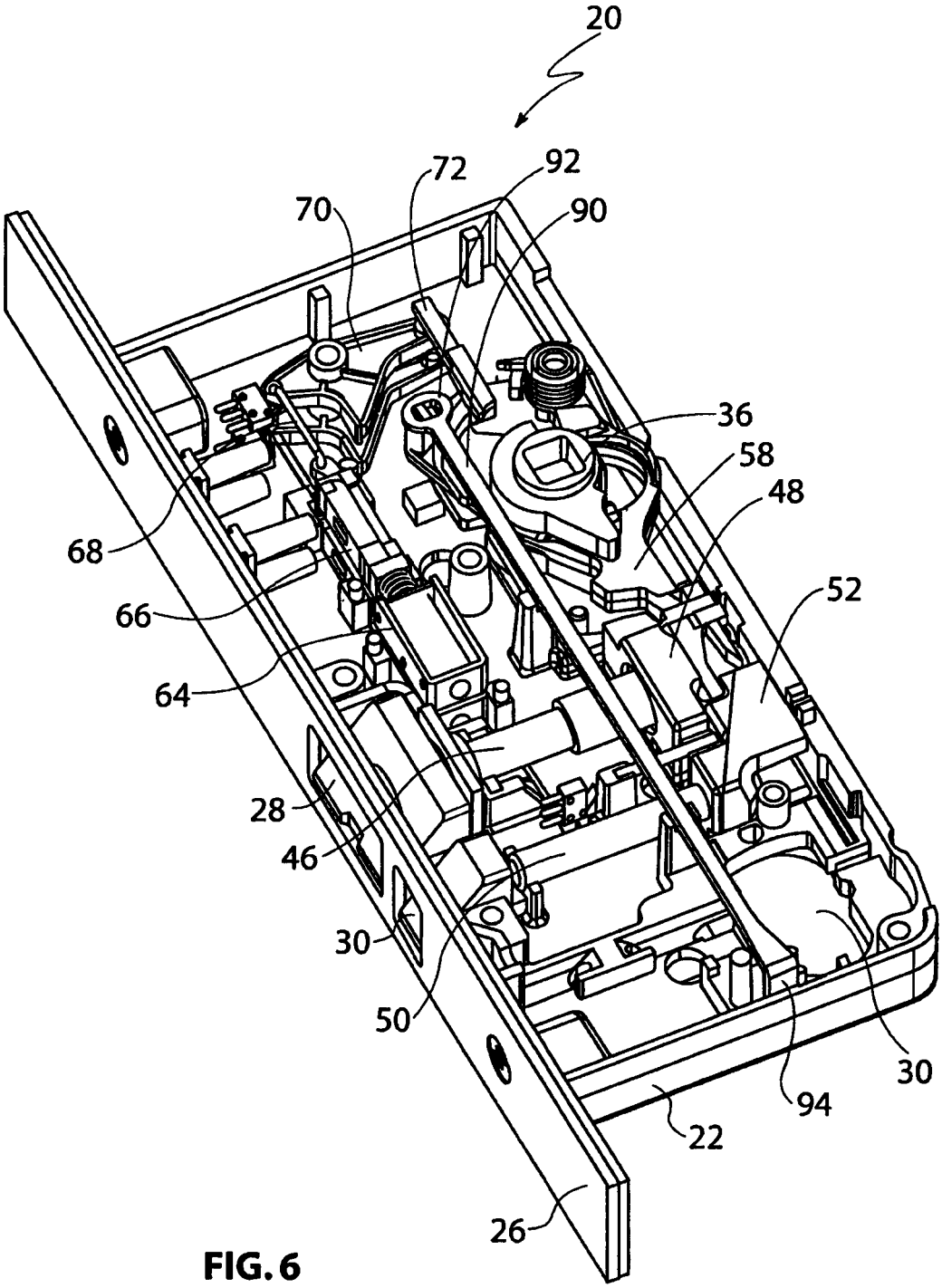
FIG. 6 shows the lock assembly of FIG. 5 with bolts retracted via key override.

FIG. 5 shows the lock assembly 20 in the same fail safe and locked configuration as FIG. 3 and also shows a key cylinder retraction bar 90. The key cylinder retraction bar 90 has a first end 92 connected to the carriage retraction arm 58 and a second end with a depending part 94. FIG. 6 shows the lock assembly 20 of FIG. 5 after the depending part 106 has been driven in a direction away from the first hub 36 by rotation of the key cylinder assembly (not shown) by a correct key. The resulting movement in the key cylinder retraction bar 90 pivots the carriage retraction arm 58 to withdraw the lock bolt 28 and the auxiliary bolt 30. It will be appreciated that this action, known as key override unlatching, withdraws the bolts 28 and 30 for door opening but does not unlock the lock assembly 20. Accordingly, as soon as torque is removed from the key used to pivot the key cylinder assembly, the springs 54 and 56 extend the bolts 28 and 30 respectively and return the lock assembly 20 to the locked configuration shown in FIG. 5.

Figure 7:
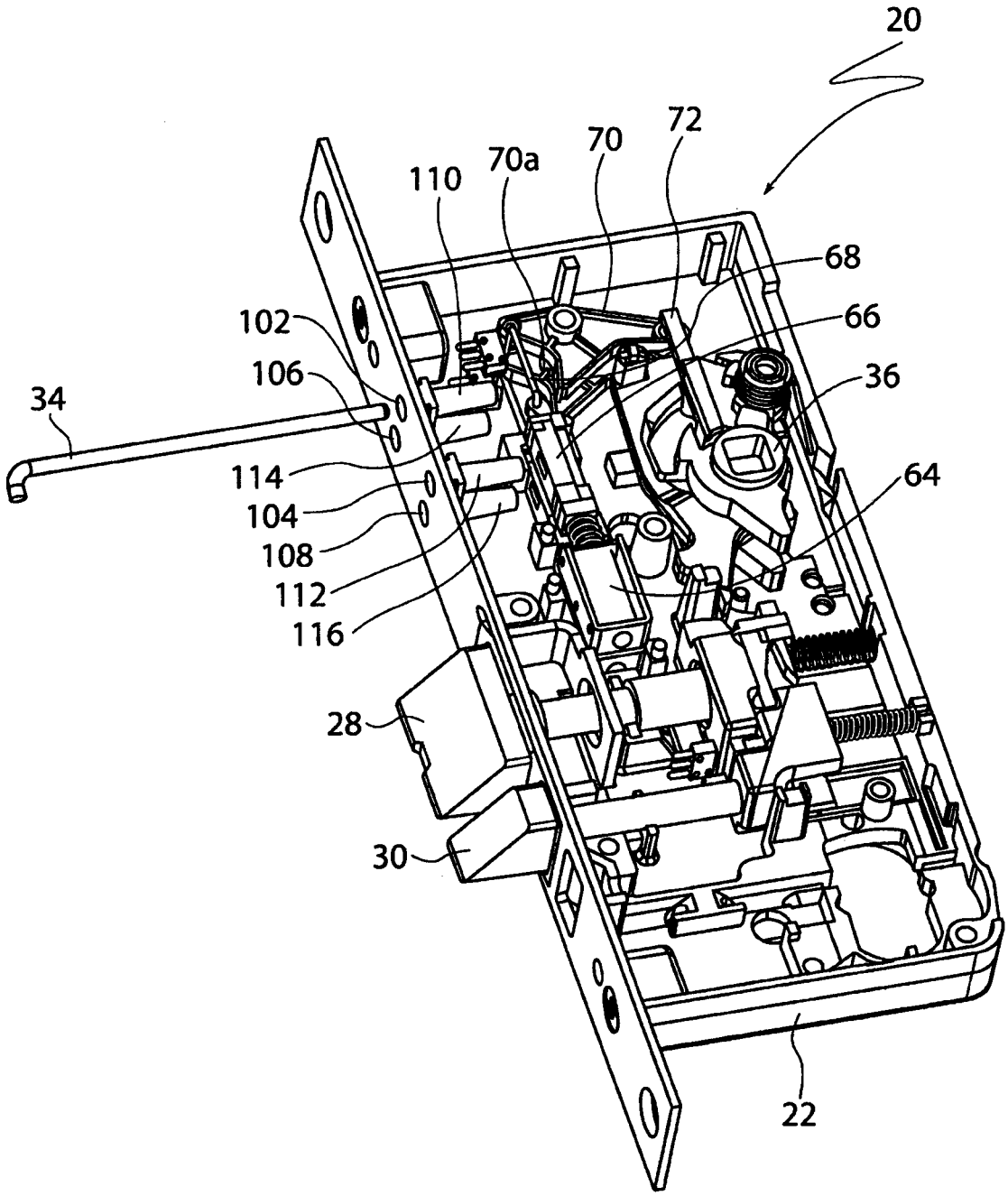
FIG. 7 shows the lock assembly of FIG. 2*a* with a face plate removed and a cylinder pin positioned for use in setting to fail secure.

FIG. 7 shows the lock assembly 20 with the face plate 26 removed. This provides access to a first fail secure adjuster setting hole 102, a first fail safe adjuster setting hole 104, a second fail secure adjuster setting hole 106 and a second fail safe adjuster setting hole 108. Each of the holes 102, 104, 106 and 108 have a respective hollow guide 110, 112, 114 and 116 in the interior of the housing 22. To change the setting of the first side of the lock assembly 20 from fail safe to fail secure, the key cylinder retaining pin 34 is inserted into the first fail secure adjuster setting hole 102 until it presses against the region 70*a* of the first lever 70. Applying force to the key cylinder retaining pin 34 then causes the first lever 70 to pivot in a counter clockwise direction, which drives the link 68 towards the first length adjustable mechanism 66. The first link 68 then drives the distal end of the connector 98 to compress the spring 94 and causes the connector 98 to pivot, due to the interaction of its curved proximal end against the spring cup 96, until it reaches the retracted configuration. This is the same as the movement described in relation to the arrow C with reference to FIGS. 13*a* to 14*b*.

Figure 8:
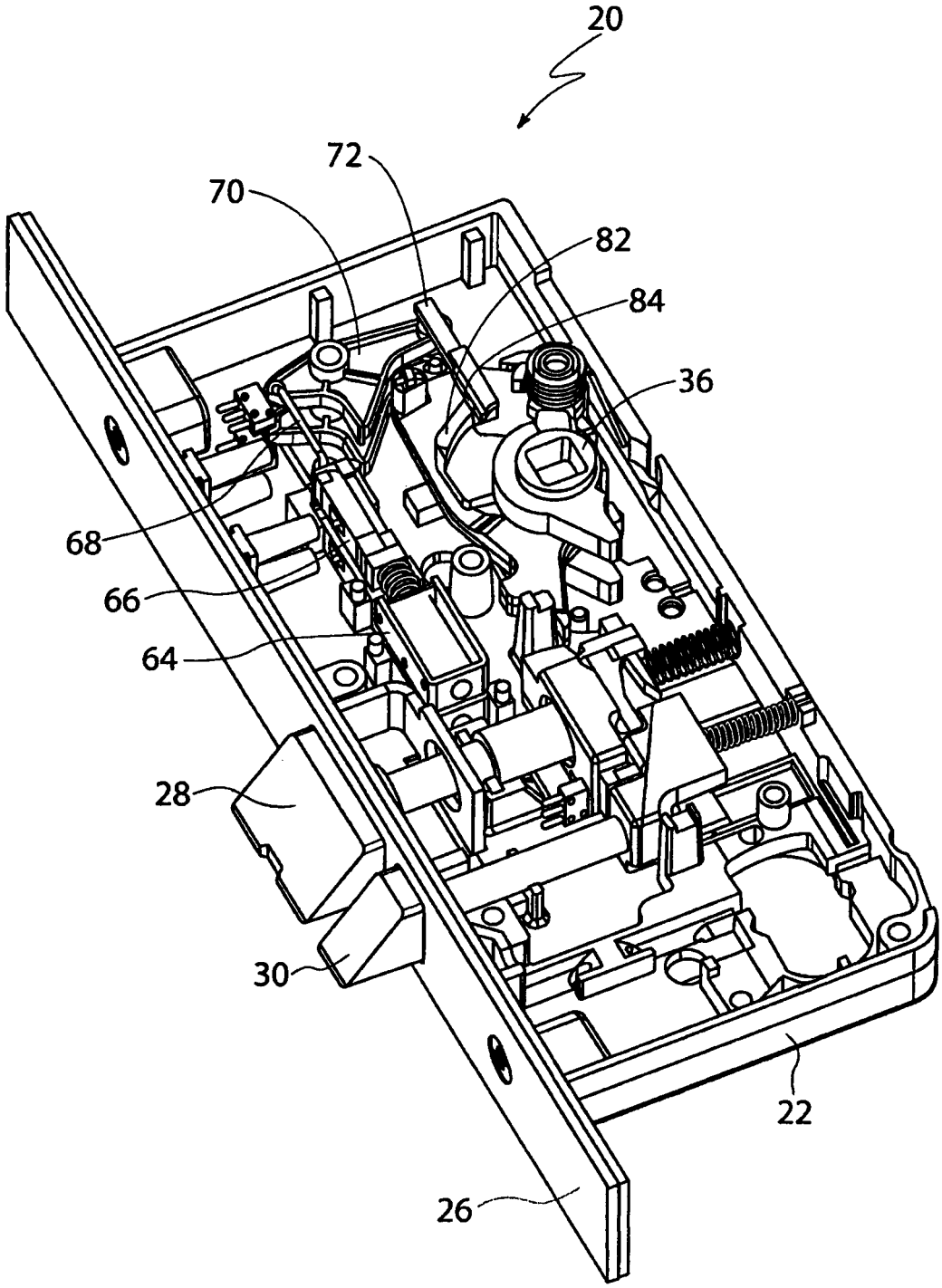
FIG. 8 shows the lock assembly of FIG. 7 set to fail secure and not energised/locked.

FIG. 8 shows the lock assembly 20 set to a fail secure configuration (i.e. the first length adjustable mechanism 66 set in the retracted configuration) after the process described with reference to FIG. 7. The first solenoid 64 is shown not energized and thus in the extended configuration. As a result, the first link 68 and the first lever 70 are positioned to place the first hub locking part 72 into the previously described second position. In the second position, the protruding part 82 is in alignment with the protruding part 84. Accordingly, when torque is applied to the first hub 36 it is unable to pivot as the protruding part 82 abuts the protruding part 84, thus locking the first side of the lock assembly 20.

Figure 9:
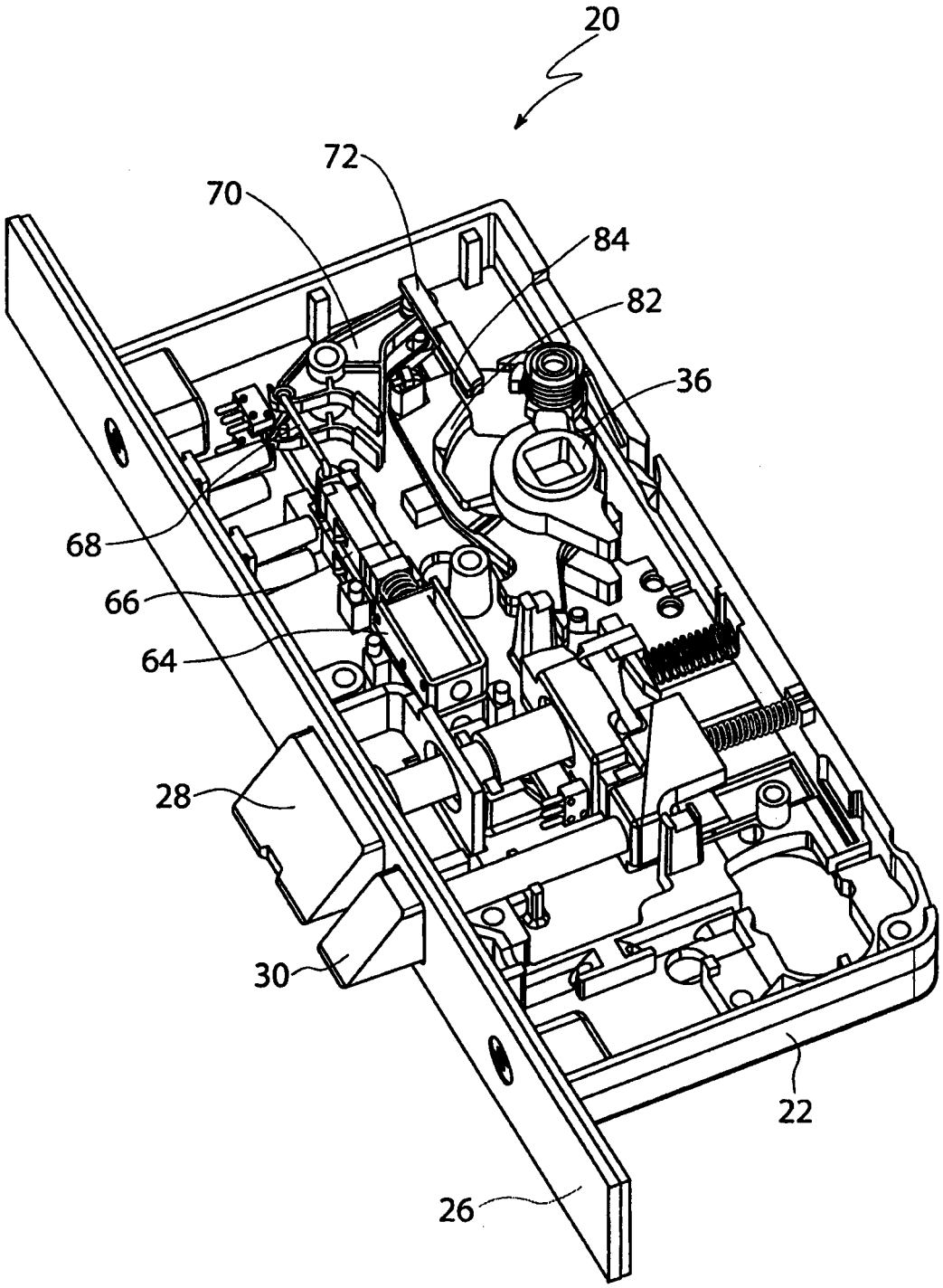
FIG. 9 shows the lock assembly of FIG. 8 set to fail secure and energised/unlocked.

FIG. 9 shows the lock assembly set to the fail secure configuration shown in FIG. 8 but with the first solenoid energized and thus in the retracted configuration. As a result, the first link 68 and the first lever 70 are positioned to place the first hub locking part 72 into what shall be referred to as a third position, further away from the first hub 36 than in the second position. In the third position, the protruding part 82 is not in alignment with the protruding part 84. Accordingly, when torque is applied to the first hub 36 the first hub 36 can pivot as the protruding part 82 passes the protruding part 84. The pivoting of the carriage retraction arm 58, in response to the pivoting of the first hub 36, withdraws the lock bolt 28 and the auxiliary bolt 30, as shown in FIG. 3.

In summary, when the first length adjustable mechanism 66 is in the retracted configuration the first side of the lock assembly 20 is set as fail secure and de-energising the first solenoid 64 drives the first locking part 72 to the second position, locking the first side of the lock assembly 20, and energising the first solenoid 64 drives the first locking part 72 to the third position, unlocking the first side of the lock assembly 20.

Figure 10:
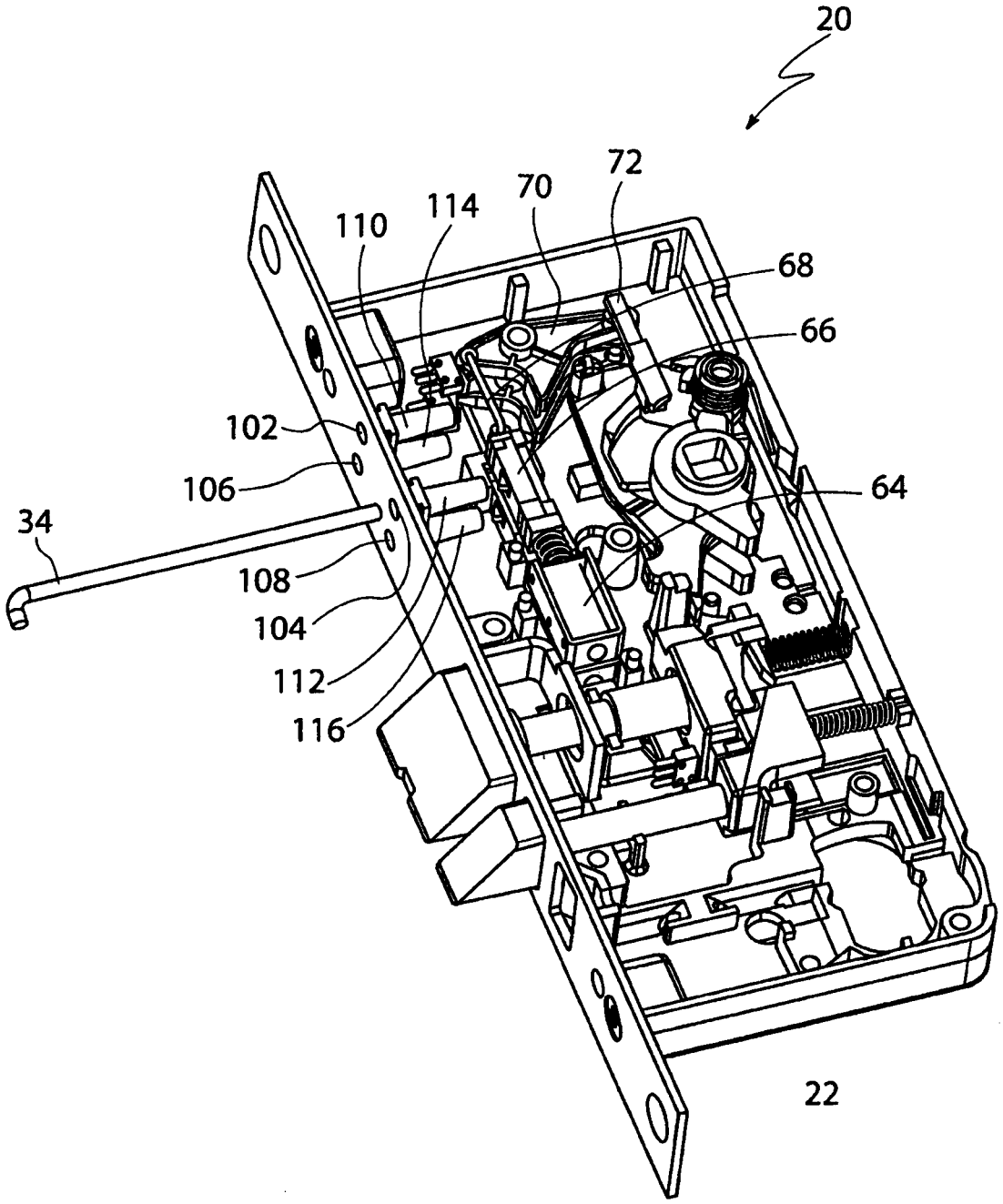
FIG. 10 shows the lock assembly of FIG. 8 with the face plate removed and the cylinder pin positioned for use in setting to fail safe.

With reference to FIG. 10, to change the first side of the lock assembly 20 from fail secure to fail safe, the key cylinder retaining pin 34 is inserted into the first fail safe adjuster setting hole 104 until it presses against the proximal end of the connector 98 in the first length adjustable mechanism 66. When force is applied to the proximal end of the connector 98, the proximal end of the connector 98 is released from engagement with the first housing part 90 and the connector 98 is propelled by the spring 94 to the extended configuration. This is the same as the movement described in relation to the arrow B with reference to FIGS. 13*a* to 14*b*. When the first length adjustable mechanism 66 is in the extended configuration the first side of the lock is set as fail safe as previously described with reference to FIGS. 3 and 4.

The second side of the lock assembly 20 operates in the same manner as described in relation to the first side. The setting of the second side as fail safe or fail secure is performed using the key cylinder pin 34 in the second fail secure adjuster setting hole 106 or the second fail safe adjuster setting hole 108, and is independent of the setting of the first side and vice versa.

The lock assembly 20 can be set as fail safe or fail secure before installation in a door. The lock assembly 20 can also be set as fail safe or fail secure after installation in a door by removal of the face plate 26 only and, advantageously, without having to disassemble the entire lock assembly 20. This greatly reduces the effort and expense of changing the lock's setting after installation if: the initial setting was incorrectly made at installation; or a change in the door's function is required due to a subsequent building or security requirement change.

Figure 11:
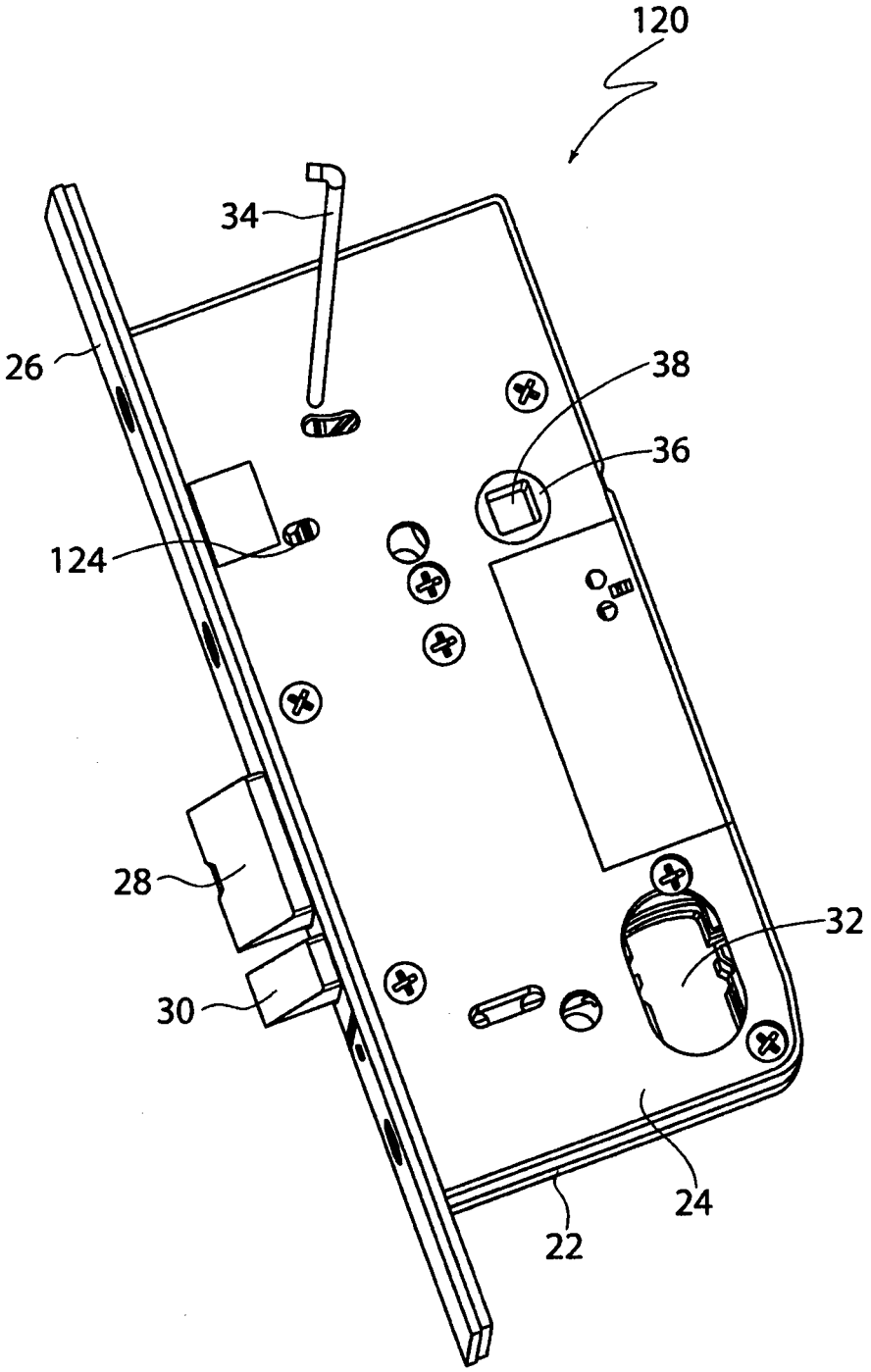
FIG. 11 is a perspective view of a second embodiment of lock assembly and a cylinder pin positioned for use in setting to fail secure.
Figure 12:
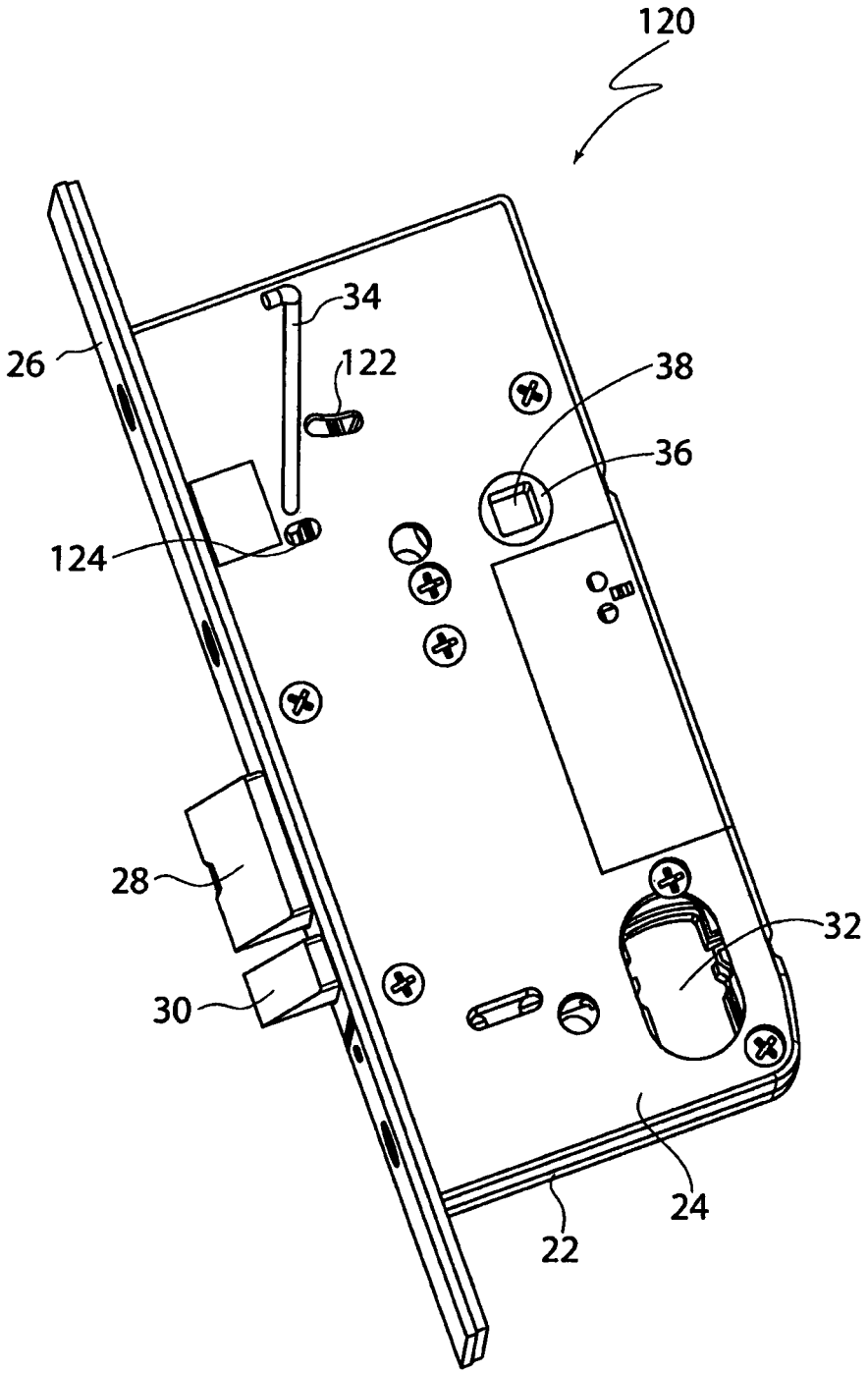
FIG. 12 shows the lock assembly shown in FIG. 11 and a cylinder pin positioned for use in setting to fail safe.

FIGS. 11 and 12 shows a second embodiment of lock assembly 120. The lock assembly 120 is similar to the lock assembly 20 and like features are indicated with like reference numerals. However, the lock assembly 120 does not include the first fail secure adjuster setting hole 102, the first fail safe adjuster setting hole 104, the second fail secure adjuster setting hole 106 or the second fail safe adjuster setting hole 108 beneath the face plate. As an alternative, the lock assembly 120 has a first fail secure adjuster setting hole 122 and a first fail safe adjuster setting hole 124 in the side cover 24 and a second fail secure adjuster setting hole and a second fail safe adjuster setting hole on the second (i.e. opposite) side of the housing 22.

As shown in FIG. 7, to change the setting of the first side of the lock assembly 20 from fail safe to fail secure, the key cylinder retaining pin 34 is inserted into the first fail secure adjuster setting hole 122 until it presses against the region 70*a* of the first lever 70 and moved laterally to cause the first lever 70 to pivot in a counter clockwise direction and drive the link 68 towards the first length adjustable mechanism 66. The first link 68 then drives the distal end of the connector 98 to compress the spring 94 and causes the connector 98 to pivot, due to the interaction of its curved proximal end against the spring cup 96, until it reaches the retracted configuration. This is the same as the movement described in relation to the arrow C with reference to FIGS. 13*a* to 14*b*.

With reference to FIG. 12, to change the setting of the first side of the lock assembly 20 from fail secure to fail safe, the key cylinder retaining pin 34 is inserted into the first fail safe adjuster setting hole 124 until it presses against the proximal end of the connector 98. The pin 34 is them moved laterally to apply force to the proximal end of the connector 98. This releases the proximal end of the connector 98 from engagement with the first housing part 90 and allows the connector 98 to be propelled by the spring 94 to the extended configuration. This is the same as the movement described in relation to the arrow B with reference to FIGS. 13*a* to 14*b*.

The lock assembly 120 can only be set as fail safe or fail secure before installation in a door or after removal of the lock assembly 120 from a door. The lock assembly 120 may be suited to more secure applications as the settings can not be tampered with without removing the lock assembly from the door.

FIGS. 15 to 19 show a third embodiment of lock assembly 140. The lock assembly 140 is also similar to the lock assembly 20 and like features are indicated with like reference numerals. However, in the lock assembly 140 the hub 36 has an inner protruding part 142 and an outer protruding part 144 separated by a slot 146 and the first hub locking part 72 has a protruding part 148 adjacent its distal end.

Figure 15:
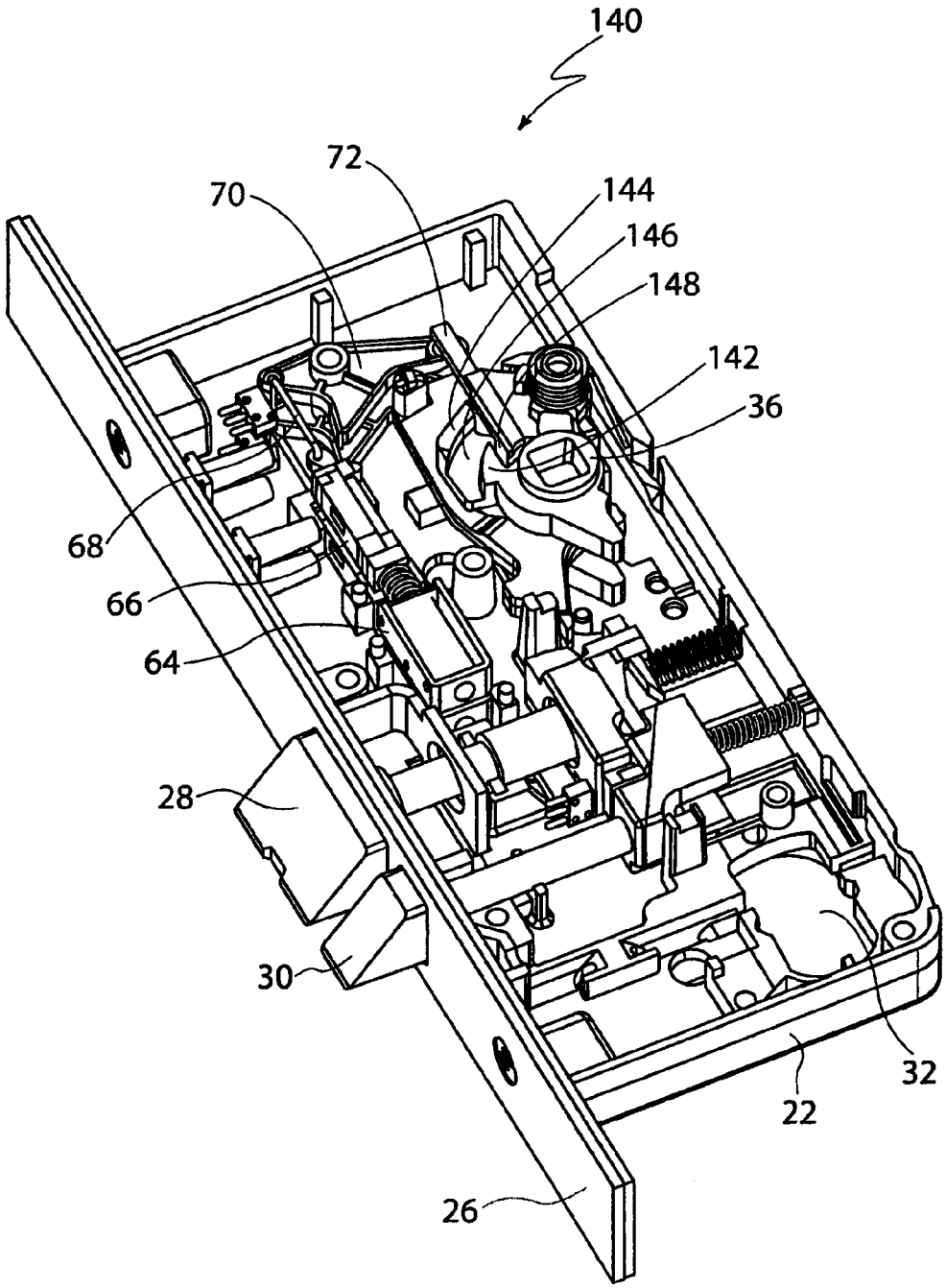
FIG. 15 is a perspective view of a third embodiment of lock assembly with a side cover removed, set to fail secure and not energised/locked.
Figure 16:
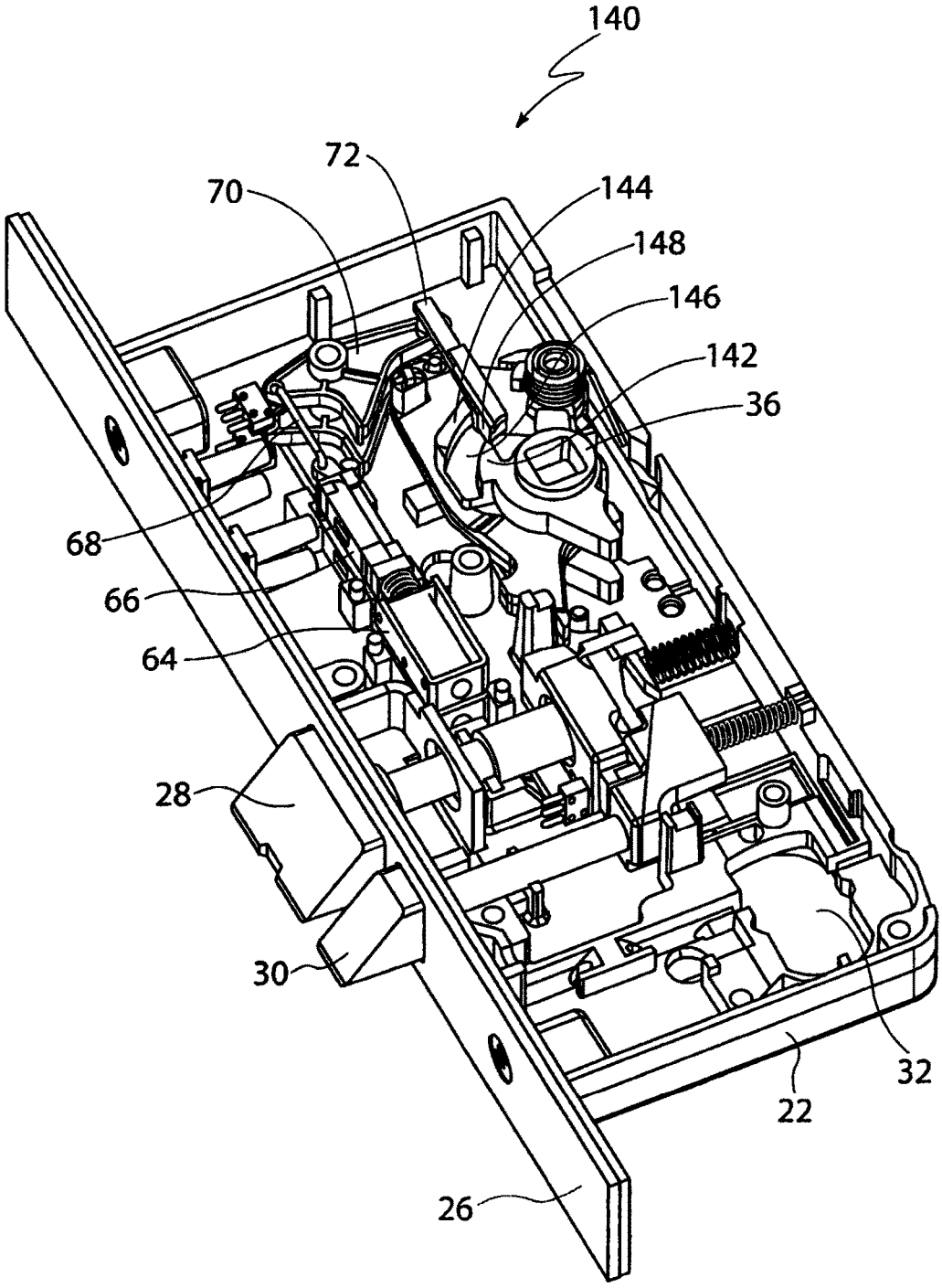
FIG. 16 shows the lock assembly of FIG. 15 set to fail secure and energised/unlocked.
Figure 17:
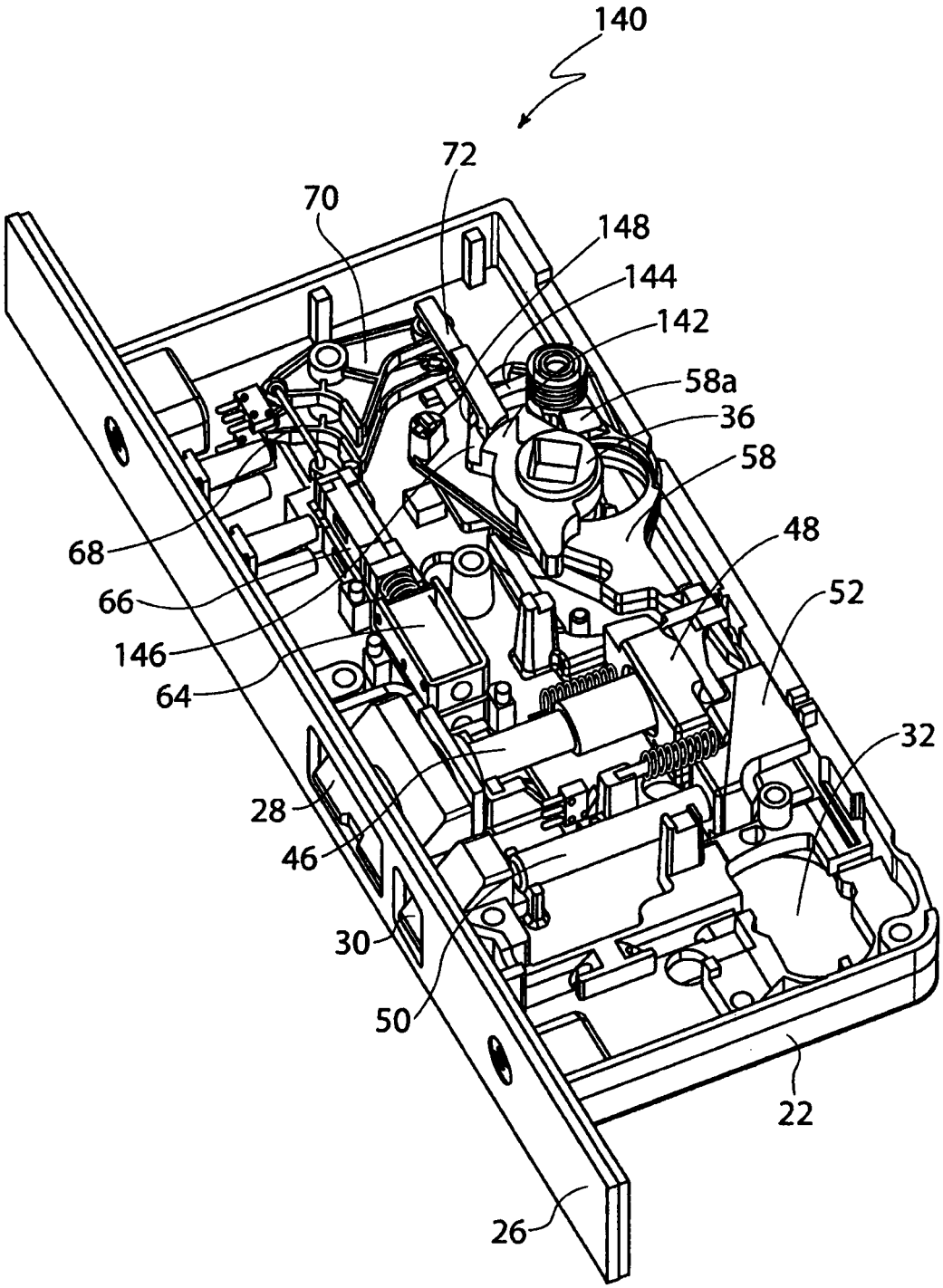
FIG. 17 shows the lock assembly of FIG. 16 with a hub rotated and bolts withdrawn.

The operation of the lock assembly 140 is similar but reversed to that previously described in relation to the lock assembly 20. As shown in FIG. 15, when the first length adjustable mechanism 66 is in the extended configuration the first side of the lock assembly 140 is set as fail secure. De-energising the first solenoid 64 drives the first locking part 72 to the first position, locking the first side of the lock assembly 140. As shown in FIG. 16, energising the first solenoid 64 drives the first locking part 72 to the second position, unlocking the first side of the lock assembly 140. As shown in FIG. 17, the bolts 28 and 30 can then be retracted.

Figure 18:
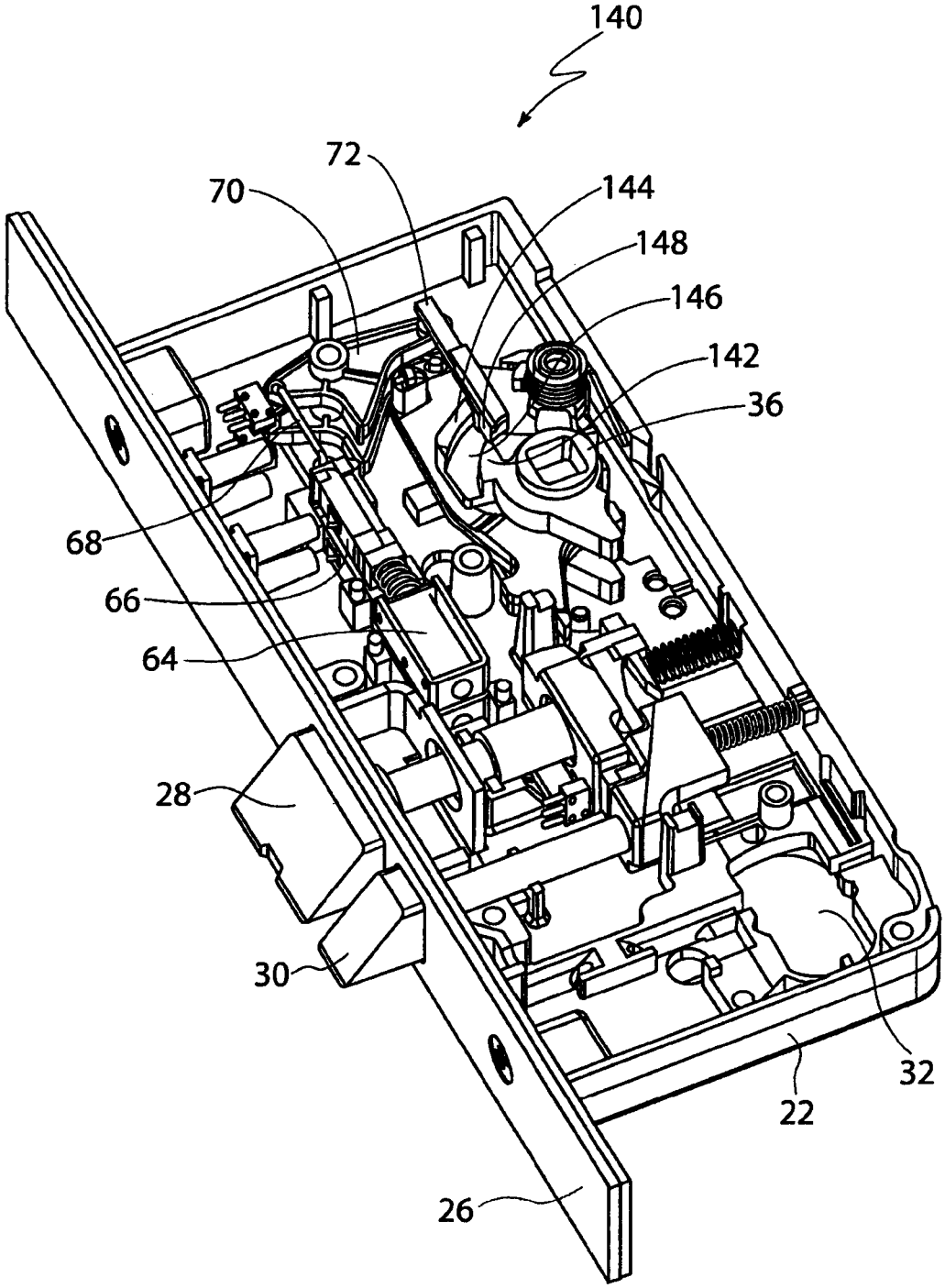
FIG. 18 shows the lock assembly of FIG. 15 set to fail safe and not energised/unlocked.
Figure 19:
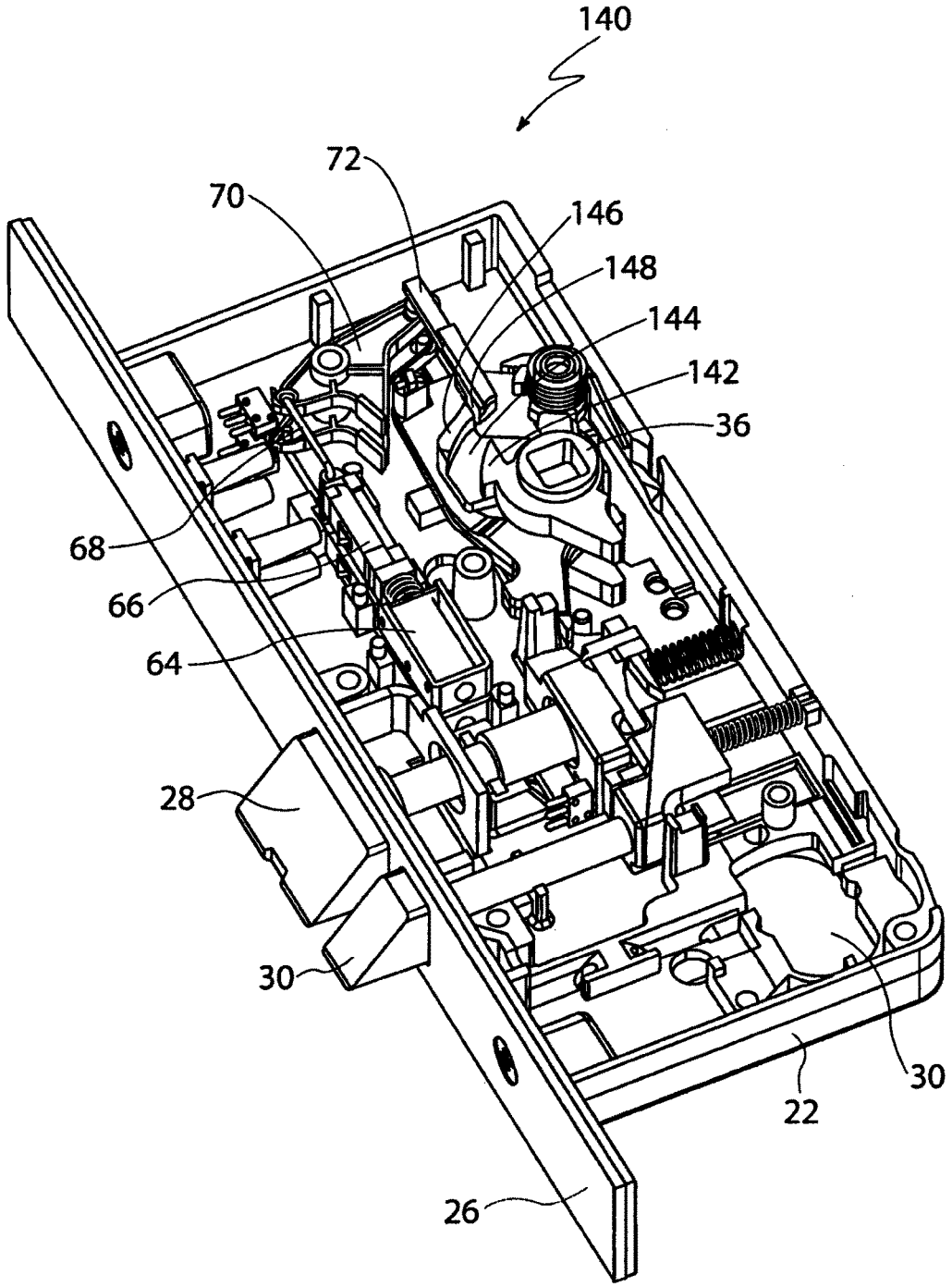
FIG. 19 shows the lock assembly of FIG. 18 set to fail safe and energised/locked.

As shown in FIG. 18, when the first length adjustable mechanism 66 is in the retracted configuration the first side of the lock assembly 140 is set as fail safe. De-energising the first solenoid 64 drives the first locking part 72 to the second position, unlocking the first side of the lock assembly 20. As shown in FIG. 19, energising the first solenoid 64 drives the first locking part 72 to the third position, locking the first side of the lock assembly 140.

By way of a comparison, the lock assembly 20 allows rotation of the hub when the hub locking part is in the first and third positions and prevents it when in the second position. The lock assembly 140 prevents rotation of the hub when the hub locking part is in the first and third positions and allows it when in the second position.

The lock assembly 140 can be set as fail safe or fail secure before installation in a door. The lock assembly 140 can also be set as fail safe or fail secure after installation in a door by removal of the face plate 26 only and, advantageously, without having to disassemble the entire lock assembly 140.

Although the invention has been described with reference to preferred embodiments, it will be appreciated by persons skilled in the art that the invention can be embodied in many other forms. For example, in the embodiments shown, the change in length of the length adjustable mechanisms between their retracted and extended configurations is approximately the same as the change in length of the solenoids between their retracted and extended configurations. However, in other embodiments (not shown) these two length changes are not the same. Also, the described embodiments show the hub locking parts moving between only three positions. However, in other embodiments (not shown) more than three positions are utilised.

The invention claimed is:

1. A lock assembly, comprising:

a housing;

a lock bolt mounted in the housing to be movable between a latching position and an unlatching position;

a first hub mounted in the housing and linked to the lock bolt to move the lock bolt in response to movement of a first handle; and a first hub locker mounted in the housing to be positionable in at least three positions, wherein the first hub locker is linked to the first hub to allow movement of the lock bolt in response to torque being applied to the first handle when in two positions of the at least three positions and to prevent movement of the lock bolt in response to torque being applied to the first handle when in another of the at least three positions, or the first hub locker is linked to the first hub to prevent movement of the lock bolt in response to torque being applied to the first handle when in two positions of the at least three positions and to allow movement of the lock bolt in response to torque being applied to the first handle when in another of the at least three positions;

wherein the first hub locker is mounted so as to be movable in a first direction from one of said two positions to said another position and from said another position to the other of said two positions to thereby select either a lock-unlock-lock operating mode or unlock-lock-unlock operating mode.

2. The lock assembly as claimed in claim 1, wherein the first hub locker is linked to the lock bolt to allow movement of the lock bolt in response to torque being applied to the first handle when in two of the at least three positions and to prevent movement of the lock bolt in response to torque being applied to the first handle when in another of the at least three positions or the first hub locker is linked to the lock bolt to prevent movement of the lock bolt in response to torque being applied to the first handle when in said two of the at least three positions and to allow movement of the lock bolt in response to torque being applied to the first handle when in said another of the at least three positions.

3. The lock assembly as claimed in claim 1, wherein the first hub locker is positionable in only three positions, and the first hub locker is linked to the lock bolt to allow movement of the lock bolt in response to torque being applied to the first handle when in two of the three positions and to prevent movement of the lock bolt in response to torque being applied to the first handle when in another of the three positions or the first hub locker is linked to the lock bolt to prevent movement of the lock bolt in response to torque being applied to the first handle when in said two of the three positions and to allow movement of the lock bolt in response to torque being applied to the first handle when in said another of the three positions.

4. The lock assembly as claimed in claim 3, wherein the first hub locker is linked to the lock bolt to allow movement of the lock bolt in response to torque being applied to the first handle when in two of the three positions and to prevent movement of the lock bolt in response to torque being applied to the first handle when in another of the three positions.

5. The lock assembly as claimed in claim 3, wherein the first hub locker is linked to the lock bolt to prevent movement of the lock bolt in response to torque being applied to the first handle when in said two of the three positions and to allow movement of the lock bolt in response to torque being applied to the first handle when in said another of the three positions.

6. The lock assembly as claimed in claim 1, wherein the first hub locker is mounted in the housing so as to be movable in a second direction, opposite to the first direction, from said other of said two positions to said another position and from said another position to said one of said two positions.

7. The lock assembly as claimed in claim 1, further comprising:

a first driver mounted in the housing, the first driving being operable to move between an extended configuration and a retracted configuration; and a first adjustable mechanism mounted in the housing and linked to the first driver, the first adjustable mechanism being constructed to move between an extended configuration and a retracted configuration, wherein:

when the first driver is in the retracted configuration and the first adjustable mechanism is in the retracted configuration, the first hub locker is positioned in one of said two positions;

when the first driver is in the retracted configuration and the first adjustable mechanism is in the extended configuration, or the first driver is in the extended configuration and the first adjustable mechanism is in the retracted configuration, the first hub locker is positioned in said another position; and when the first driver is in the extended configuration and the first adjustable mechanism is in the extended configuration, the first hub locker is positioned in the other of said two positions.

8. The lock assembly as claimed in claim 1, further comprising:

a first driver mounted in the housing and constructed to be drivable to a retracted configuration and biased to an extended configuration; and a first adjustable mechanism mounted in the housing and constructed to be settable in an extended configuration or a retracted configuration.

9. The lock assembly as claimed in claim 1 further comprising:

a first driver mounted in the housing and constructed to be drivable to an extended configuration and biased to a retracted configuration; and a first adjustable mechanism mounted in the housing and constructed to be settable in an extended configuration or a retracted configuration.

10. The lock assembly as claimed in claim 7, wherein the first adjustable mechanism is a first length adjustable mechanism, having a relatively longer length in the extended configuration and a relatively shorter length in the retracted configuration.

11. The lock assembly as claimed in claim 1, further comprising:

a second hub mounted in the housing and linked to the lock bolt to move the lock bolt in response to movement of a second handle; and a second hub locker mounted in the housing to be positionable in at least three positions, wherein the second hub locker is linked to the second hub to allow movement of the lock bolt in response to torque being applied to the second handle when in two of the at least three positions and to prevent movement of the lock bolt in response to torque being applied to the second handle when in another of the at least three positions or the second hub locker is linked to the second hub to prevent movement of the lock bolt in response to torque being applied to the second handle when in two of the at least three positions and to allow movement of the lock bolt in response to torque being applied to the second handle when in another of the at least three positions.

* * * * *